US010545417B1

(12) United States Patent
Kami et al.

(10) Patent No.: US 10,545,417 B1
(45) Date of Patent: Jan. 28, 2020

(54) ELECTROPHOTOGRAPHIC PHOTOCONDUCTOR, IMAGE FORMING APPARATUS, AND IMAGE FORMING METHOD

(71) Applicants: Hidetoshi Kami, Shizuoka (JP); Tomoharu Asano, Kanagawa (JP)

(72) Inventors: Hidetoshi Kami, Shizuoka (JP); Tomoharu Asano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/445,973

(22) Filed: Jun. 19, 2019

(30) Foreign Application Priority Data

Jul. 30, 2018 (JP) ..... 2018-142397

(51) Int. Cl.

| | |
|---|---|
| ***G03G 5/00*** | (2006.01) |
| ***G03G 5/047*** | (2006.01) |
| ***G03G 5/07*** | (2006.01) |
| ***G03G 5/05*** | (2006.01) |
| ***G03G 5/147*** | (2006.01) |

(52) U.S. Cl.
CPC ..... *G03G 5/047* (2013.01); *G03G 5/051* (2013.01); *G03G 5/075* (2013.01); *G03G 5/14708* (2013.01); *G03G 5/14713* (2013.01); *G03G 5/14726* (2013.01)

(58) Field of Classification Search
CPC ..... G03G 5/14708; G03G 5/14713; G03G 5/14726
USPC ..... 430/66
See application file for complete search history.

(56) References Cited

U.S. PATENT DOCUMENTS

| | | | |
|---|---|---|---|
| 6,030,733 | A | 2/2000 | Kami et al. |
| 6,151,468 | A | 11/2000 | Kami et al. |
| 6,653,033 | B1 | 11/2003 | Kami et al. |
| 2002/0106570 | A1 | 8/2002 | Kami et al. |
| 2003/0113642 | A1 | 6/2003 | Kami et al. |
| 2004/0185358 | A1 | 9/2004 | Kami |
| 2005/0026058 | A1 | 2/2005 | Kami et al. |
| 2005/0106482 | A1 | 5/2005 | Kami et al. |
| 2005/0181291 | A1 | 8/2005 | Kami et al. |

(Continued)

FOREIGN PATENT DOCUMENTS

| | | |
|---|---|---|
| JP | 2005-043623 | 2/2005 |
| JP | 2005-062830 | 3/2005 |

(Continued)

OTHER PUBLICATIONS

U.S. Appl. No. 16/290,995, filed Mar. 4, 2019, Hidetoshi Kami, et al.

*Primary Examiner* — Mark A Chapman
(74) *Attorney, Agent, or Firm* — Oblon, McClelland, Maier & Neustadt, L.L.P.

(57) ABSTRACT

An electrophotographic photoconductor is provided. The electrophotographic photoconductor includes a conductive substrate, a photosensitive layer, and a surface layer containing fluororesin particles, non-fluororesin particles, and a cured resin. The fluororesin particles have an average particle diameter of from 0.01 to 0.3 μm in a cross-sectional image of the surface layer as observed by a scanning electron microscope with a magnification of 5,000 times, and when the cross-sectional image is segmented into uniform regions each being 1 μm×4 μm, a standard deviation of areas each of which is occupied by the fluororesin particles and the non-fluororesin particles in each of the regions is 0.2 $\mu m^2$ or less.

5 Claims, 7 Drawing Sheets

(56) References Cited

U.S. PATENT DOCUMENTS

| | | | |
|---|---|---|---|
| 2006/0286473 | A1 | 12/2006 | Kami |
| 2008/0085459 | A1 | 4/2008 | Kami et al. |
| 2008/0227008 | A1 | 9/2008 | Kami et al. |
| 2008/0311499 | A1 | 12/2008 | Kami et al. |
| 2009/0067891 | A1 | 3/2009 | Kami et al. |
| 2009/0208246 | A1 | 8/2009 | Kami |
| 2010/0316423 | A1 | 12/2010 | Kami et al. |
| 2011/0076057 | A1 | 3/2011 | Kami et al. |
| 2011/0200924 | A1 | 8/2011 | Kami et al. |
| 2012/0008984 | A1 | 1/2012 | Kami et al. |
| 2012/0052424 | A1 | 3/2012 | Asano et al. |
| 2012/0183310 | A1 | 7/2012 | Asano et al. |
| 2012/0237228 | A1 | 9/2012 | Kami |
| 2013/0059242 | A1 | 3/2013 | Asano et al. |
| 2013/0251401 | A1 | 9/2013 | Asano et al. |
| 2014/0193185 | A1 | 7/2014 | Kami et al. |
| 2015/0227063 | A1 | 8/2015 | Kami et al. |
| 2015/0346613 | A1 | 12/2015 | Kami et al. |
| 2016/0161871 | A1 | 6/2016 | Asano et al. |
| 2017/0153559 | A1 | 6/2017 | Asano et al. |
| 2017/0307988 | A1 | 10/2017 | Asano et al. |
| 2018/0113403 | A1 | 4/2018 | Kami et al. |

FOREIGN PATENT DOCUMENTS

| | | |
|---|---|---|
| JP | 2005-345662 | 12/2005 |
| JP | 2007-011006 | 1/2007 |
| JP | 2013-054132 | 3/2013 |
| JP | 2014-059411 | 4/2014 |
| JP | 2014-059459 | 4/2014 |

ELECTROPHOTOGRAPHIC PHOTOCONDUCTOR, IMAGE FORMING APPARATUS, AND IMAGE FORMING METHOD

CROSS-REFERENCE TO RELATED APPLICATIONS

This patent application is based on and claims priority pursuant to 35 U.S.C. § 119(a) to Japanese Patent Application No. 2018-142397, filed on Jul. 30, 2018 in the Japan Patent Office, the entire disclosure of which is hereby incorporated by reference herein.

BACKGROUND

Technical Field

The present disclosure relates to an electrophotographic photoconductor, an image forming apparatus, and an image forming method.

Description of the Related Art

In the past, most documents were printed with electrophotographic copiers and used in all scenes. In recent years, however, the opportunity to copy documents at office scenes has shrunk year by year by taking advantage of paperless and cost-cutting activities. While the conventional role of electrophotography is finishing, the application thereof is trying to expand from office printing to commercial printing. Electrophotography has an advantage of being able to perform on-demand printing that allows printing of a large variety of documents in a very small lot, since a plate-making process as in offset printing is not required. However, the quality and homogeneity of the printed matter are actually far inferior to offset printing.

In commercial printing, printed matter with nonuniform image quality will not be a commercial product. For this reason, in order to use electrophotography in commercial printing, uniform image quality is particularly necessary. In addition, since productivity and profitability are more important in commercial printing than in office applications, it is necessary to reduce the frequency of replacement of photoconductors. At present, the replacement life of photoconductor used in high-end electrophotographic apparatuses is often set to about one million sheets. Even this is not sufficient as durability in commercial printing. It can be said that the performance of electrophotography is still insufficient based on the fact that copiers have not been replaced by offset printers so far.

One of the factors limiting expansion of the application of electrophotography is the lifespan of electrophotographic photoconductors.

Therefore, various proposals have been made to provide an electrophotographic photoconductor that can be used repeatedly.

SUMMARY

In accordance with some embodiments of the present invention, an electrophotographic photoconductor is provided. The electrophotographic photoconductor includes a conductive substrate, a photosensitive layer, and a surface layer containing fluororesin particles, non-fluororesin particles, and a cured resin. The fluororesin particles have an average particle diameter of from 0.01 to 0.3 μm in a cross-sectional image of the surface layer as observed by a scanning electron microscope with a magnification of 5,000 times, and when the cross-sectional image is segmented into uniform regions each being 1 μm×4 μm, a standard deviation of areas each of which is occupied by the fluororesin particles and the non-fluororesin particles in each of the regions is 0.2 $\mu m^2$ or less.

In accordance with some embodiments of the present invention, an image forming apparatus is provided. The image forming apparatus includes the above-described electrophotographic photoconductor and a lubricant supply device configured to supply a lubricant to the electrophotographic photoconductor.

In accordance with some embodiments of the present invention, an image forming method is provided. The image forming method includes the processes of forming an electrostatic latent image on the above-described electrophotographic photoconductor according and supplying a lubricant to the electrophotographic photoconductor.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1A:
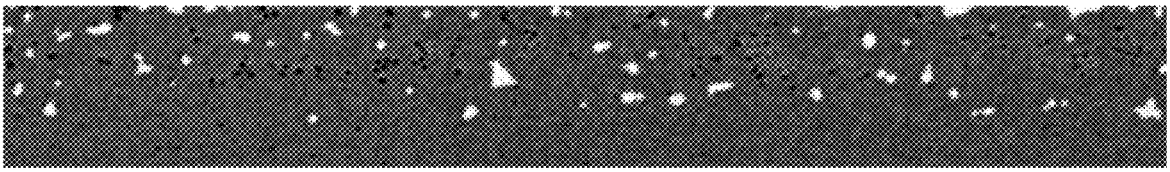
FIG. 1A is a cross-sectional image of a surface layer of an electrophotographic photoconductor according to an embodiment of the present invention observed by a scanning electron microscope (SEM)

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

According to an embodiment of the present invention, an electrophotographic photoconductor having both satisfactory wear resistance and image blurring preventing property is provided.

For electrophotographic photoconductors, wear resistance and image blurring preventing property are in a trade-off relation. When the electrophotographic photoconductor is regarded as a type of capacitor, the electrostatic capacity increases and the chargeability deteriorates as wear of the electrophotographic photoconductor progresses. As a result, the printed image is likely to have fogging. In addition, as a result of the electric field received by the photosensitive layer becoming stronger, it is likely that the charge blocking property lowers and background fouling occurs. Such deterioration in chargeability can be delayed by improving wear resistance of the photoconductor. However, as the wear resistance is improved, wear of the surface of the photoconductor is delayed, and contamination is likely to be accumulated on the surface without the surface being refreshed. The contaminated surface of the photoconductor tends to have a low surface resistivity and, on a damp day, may cause image blurring that is a phenomenon in which an electrostatic latent image flows laterally to blur. Although there is a need for improving wear resistance, image blurring occurs when wear resistance is improved too much, resulting in a trade-off relation between wear resistance and image blurring preventing property. Thus, the lifespan of the electrophotographic photoconductor has been plateaued. For this reason, expansion of the application of electrophotography has also been limited.

As described above, various proposals have been made to provide an electrophotographic photoconductor that can be used repeatedly. However, the conventional technologies are not sufficient for electrophotographic photoconductors to achieve both wear resistance and image blurring preventing property.

As a result of repeated researches, the inventors of the present invention have found that an electrophotographic photoconductor having the following configuration is effective for improving both wear resistance and image blurring preventing property.

That is, it was found to be effective to make the surface layer of the electrophotographic photoconductor contain fluororesin particles, non-fluororesin particles, and a cured resin and adjust the average particle diameter of the fluororesin particles within a specific range. Furthermore, it was found to be effective, when a cross-sectional image of the surface layer is segmented into uniform regions with a predetermined size, to set the standard deviation of areas each of which is occupied by the fluororesin particles and the non-fluororesin particles in each region within a specific range.

According to an embodiment of the present invention, an electrophotographic photoconductor having both satisfactory wear resistance and image blurring preventing property is provided.

In an image forming apparatus equipped with an electrophotographic photoconductor, it is preferable that a lubricant is applied to the photoconductor to reduce wear of the photoconductor and to maintain cleanability of the surface of the photoconductor.

In the image forming apparatus in which a lubricant is applied to the electrophotographic photoconductor, the balance between supply and removal of the lubricant exerts a great effect on wear resistance and image blurring preventing property of the electrophotographic photoconductor. With respect to wear, uneven wear of the electrophotographic photoconductor occurs according to uneven application of the lubricant. Since an image defect such as background fouling occurs at a position where uneven wear progresses, the lifespan of the electrophotographic photoconductor is determined by a local portion which causes uneven wear at the highest wear rate. With respect to image blurring, if the lubricant once supplied to the surface of the electrophotographic photoconductor indefinitely remains on the surface without being removed, the lubricant may deteriorate by molecular breakage or the like. Deteriorated lubricant is increased in surface free energy and easily adsorb electric discharge products and moisture, inducing image blurring. In a case in which fluororesin particles are blended in the surface layer of the electrophotographic photoconductor, when appropriate wettability of the lubricant is lost, protection of the surface of the electrophotographic photoconductor achieved by application of the lubricant is lost. As a result, the fluororesin particles get stuck on the surface of the electrophotographic photoconductor, causing filming and inducing image blurring.

This local image blurring also affects the lifespan of the electrophotographic photoconductor. Therefore, in the case of outputting a print image that requires homogeneity, the lifespan of the electrophotographic photoconductor should be increased by improving a performance which is locally weak rather than the average performance. In view of these situations, to increase wear resistance of the electrophotographic photoconductor and the local surface performance thereof, an embodiment of the present invention provides an electrophotographic photoconductor in which fluororesin particles and non-fluororesin particles are blended in the surface layer and dispersion states of these particles are controlled.

By using the electrophotographic photoconductor according to an embodiment of the present invention, provided is an image forming apparatus that is excellent in durability of electrophotographic photoconductor even with the use of a lubricant and that enables mass output of prints with highly uniform image quality.

Electrophotographic Photoconductor

To achieve both electrostatic property and durability at high levels, it is effective that the electrophotographic photoconductor has a function separation configuration in which a charge generation layer and a charge transport layer are separated and that a surface protective layer is provided at the surface of the electrophotographic photoconductor.

The electrophotographic photoconductor has a photosensitive layer on a conductive substrate.

Conductive Substrate

The conductive substrate is not particularly limited and can be appropriately selected according to the purpose as long as the volume resistivity thereof is $10^{10}\Omega\cdot cm^3$ or less. For example, plastic films, plastic cylinders, and paper sheets each coated with a metal (e.g., aluminum, nickel, chromium, nichrome, copper, gold, silver, platinum) or a metal oxide (e.g., tin oxide, indium oxide) by vapor deposition or sputtering may be used. Alternatively, plates of aluminum, aluminum alloy, nickel, or stainless steel, and those made into tubes by drawing ironing, impact ironing, extruded ironing, extruded drawing, or cutting, followed by surface treatment by cutting, super finishing, or polishing, may also be used.

Intermediate Layer

The electrophotographic photoconductor according to an embodiment of the present invention may have an intermediate layer between the conductive substrate and the photosensitive layer. The intermediate layer is provided for improving adhesion, preventing moire, improving coatability of the upper layer, and preventing charge injection from the conductive substrate.

The intermediate layer generally contains a resin as the main component. Since the photosensitive layer is generally applied onto the intermediate layer, a thermosetting resin which is poorly soluble in an organic solvent is suitable for the resin of the intermediate layer. In particular, polyurethane, melamine resin, and alkyd-melamine resin sufficiently satisfy the above objects and are particularly preferable materials. An appropriate dilution of these resins with a solvent such as tetrahydrofuran, cyclohexanone, dioxane, dichloroethane, and butanone can be used as a coating material.

Furthermore, fine particles of a metal or metal oxide may be added to the intermediate layer to adjust conductivity or to prevent moire. In particular, titanium oxide or zinc oxide is preferably used.

The fine particles may be dispersed in a solvent such as tetrahydrofuran, cyclohexanone, dioxane, dichloroethane, and butanone by a ball mill, an attritor, a sand mill, or the like. This dispersion liquid may be mixed with the resin component to prepare a coating material.

The intermediate layer is formed on the conductive substrate as a film of the above-described coating material by dip coating, spray coating, bead coating, or the like. If necessary, the intermediate layer is formed by heat curing. The thickness of the intermediate layer is preferably about 2 to 20 μm. When accumulation of residual potential of the electrophotographic photoconductor is large, the thickness is preferably less than 3 μm.

Photosensitive Layer

Preferably, the photosensitive layer of the electrophotographic photoconductor is a laminated photosensitive layer in which a charge generation layer and a charge transport layer are laminated.

Charge Generation Layer

The charge generation layer refers to a part of the laminated photosensitive layer and has a function of generating charge upon exposure to light. The charge generation layer contains a charge generation material as the main component. The charge generation layer may optionally contain a binder resin. The charge generation material may be either an inorganic material and an organic material.

Examples of the inorganic material include, but are not limited to, crystalline selenium, amorphous selenium, selenium-tellurium, selenium-tellurium-halogen, selenium-arsenic compounds, and amorphous silicon. As amorphous silicon, one obtained by terminating dangling bonds with hydrogen atoms or halogen atoms, or one doped with boron atoms, phosphorus atoms, or the like, is preferably used.

Examples of the organic material include known materials such as metal phthalocyanines such as titanyl phthalocyanine and chlorogallium phthalocyanine, metal-free phthalocyanines, azulenium salt pigments, squaric acid methine pigments, symmetrical or asymmetrical azo pigments having a carbazole backbone, symmetrical or asymmetrical azo pigments having a triphenylamine backbone, symmetrical or asymmetrical azo pigments having a fluorenone backbone, and perylene pigments. Among them, metal phthalocyanines, symmetrical or asymmetrical azo pigments having a fluorenone backbone, symmetrical or asymmetrical azo pigments having a triphenylamine backbone, and perylene pigments have high quantum efficiency in charge generation and are suitable materials for the present disclosure. Each of these charge generation materials may be used alone or in combination with others.

Examples of the binder resin optionally contained in the charge generation layer include, but are not limited to, polyamide, polyurethane, epoxy resin, polyketone, polycarbonate, polyarylate, silicone resin, acrylic resin, polyvinyl butyral, polyvinyl formal, polyvinyl ketone, polystyrene, poly-N-vinylcarbazole, and polyacrylamide. In addition, high molecular charge transport materials to be described later can also be used. Among these, polyvinyl butyral is often used and is useful. Each of these binder resins may be used alone or in combination with others.

The method of forming the charge generation layer is roughly divided into vacuum thin film preparation and casting from a solution dispersion system.

The vacuum thin film preparation includes vacuum evaporation, glow discharge decomposition, ion plating, sputtering, reactive sputtering, and CVD (chemical vapor deposition), and well forms a layer containing the above-described inorganic or organic materials.

To provide the charge generation layer by casting, the above-described inorganic or organic charge generation material, together with a binder resin if necessary, is dispersed in a solvent such as tetrahydrofuran, cyclohexanone, dioxane, dichloroethane, and butanone using a ball mill, an attritor, a sand mill, or the like, followed by appropriate dilution, and the resulting liquid dispersion is applied. Among these solvents, methyl ethyl ketone, tetrahydrofuran, and cyclohexanone are preferable because they have a lower degree of environmental impact as compared with chlorobenzene, dichloromethane, toluene, and xylene. Application may be performed by dip coating, spray coating, bead coating, or the like.

The thickness of the charge generation layer thus provided is typically from 0.01 to 5 μm.

Reduction of residual potential and increase of sensitivity are often achieved by thickening the charge generation layer. On the other hand, in many cases, charge properties such as charge retentivity and space charge formation deteriorate. To balance these properties, the thickness of the charge generation layer is preferably in the range of from 0.05 to 2 μm.

If necessary, a low molecular compound such as an antioxidant, a plasticizer, a lubricant, and a ultraviolet absorber and a leveling agent can be further added to the charge generation layer. Each of these compounds can be used alone or in combination with others. When the low molecular compound and the leveling agent are used in combination, sensitivity deteriorates in many cases. Therefore, the combined amount of the low molecular compound and the leveling agent is preferably from 0.1 to 20 phr (parts per hundred parts of rubber(resin)), and more preferably from 0.1 to 10 phr. The suitable amount of the leveling agent is from 0.001 to 0.1 phr.

Charge Transport Layer

The charge transport layer has functions of injecting and transporting the charge generated in the charge generation layer and neutralizing the surface charge of the photoconductor provided by charging, and forms a part of the laminated photosensitive layer. The main components of the charge transport layer include charge transport components and binder components.

Examples of usable charge transport materials as the charge transport components include, but are not limited to, low molecular electron transport materials, hole transport materials, and high molecular charge transport materials.

Examples of the electron transport materials include, but are not limited to, electron accepting materials such as asymmetrical diphenoquinone derivatives, fluorene derivatives, and naphthalimide derivatives. Each of these electron transport materials may be used alone or in combination with others.

Preferred examples of the hole transport materials include electron donating materials. Specific examples thereof include, but are not limited to, oxazole derivatives, oxadiazole derivatives, imidazole derivatives, triphenylamine derivatives, butadiene derivatives, 9-(p-diethylaminostyrylanthracene), 1,1-bis-(4-dibenzylaminophenyl)propane, styrylanthracene, styrylpyrazoline, phenylhydrazones, α-phenylstilbene derivatives, thiazole derivatives, triazole derivatives, phenazine derivatives, acridine derivatives, benzofuran derivatives, benzimidazole derivatives, and thiophene derivatives. Each of these hole transport materials may be used alone or in combination with others.

Examples of the high molecular charge transport materials include, but are not limited to, a polymer having a carbazole ring such as poly-N-vinylcarbazole, a polymer having a hydrazone structure, a polysilylene polymer, and an aromatic polycarbonate. Each of these high molecular charge transport materials can be used alone or in combination with others.

When a surface layer comprised of a cross-linked resin (hereinafter "surface cross-linked resin layer") is laminated on the charge transport layer, the high molecular charge transport material is less likely to allow components of the charge transport layer to exude to the surface cross-linked resin layer, as compared with the low molecular charge transport material. Thus, the high molecular charge transport material is a suitable material for preventing defective curing of the surface cross-linked resin layer. In addition, the charge transport material with a high molecular weight has excellent heat resistance and is less likely to be deteriorated by heat generated when the surface cross-linked resin layer is formed by curing, which is advantageous.

As the binder component of the charge transport layer, the following high molecular compounds can be used: thermoplastic or thermosetting resins such as polystyrene, polyester, polyvinyl, polyarylate, polycarbonate, acrylic resin, silicone resin, fluororesin, epoxy resin, melamine resin, urethane resin, phenol resin, and alkyd resin. Among them, polystyrene, polyester, polyarylate, and polycarbonate exhibit good charge transfer property and are useful as the binder component of the charge transport layer. On the upper surface of the charge transport layer, the surface cross-linked resin layer is preferably laminated. Therefore, the charge transport layer is not required to have mechanical strength required for conventional charge transport layers. For this reason, materials such as polystyrene, which have high transparency but low mechanical strength and have been considered difficult to apply in the conventional techniques, can also be effectively used as the binder component of the charge transport layer.

Each of these high molecular compounds can be used alone or in combination with others. In addition, a copolymer composed of two or more types of raw material monomers thereof can be used. Further, those copolymerized with a charge transport material can also be used.

To modify the charge transport layer, the following electrically inactive high molecular compounds can be used: cardo-polymer-type polyester having a bulky backbone such as fluorene; polyester such as polyethylene terephthalate and polyethylene naphthalate; polycarbonate in which the 3 and 3' positions of the phenol components of a bisphenol-type polycarbonate are alkyl-substituted, such as C-type polycarbonate; polycarbonate in which the geminal methyl group of bisphenol A is substituted with a long-chain alkyl group having 2 or more carbon atoms; polycarbonate having a biphenyl or biphenyl ether backbone; polycaprolactone; polycarbonate having a long-chain alkyl backbone such as polycaprolactone; acrylic resin; polystyrene; and hydrogenated butadiene.

Here, the electrically inactive high molecular compound refers to a high molecular compound free of a chemical structure exhibiting photoconductivity such as a triarylamine structure. When such a high molecular compound is used as an additive in combination with a binder component, the addition amount thereof is preferably 50% by mass or less based on the total solid content of the charge transport layer in view of restriction of photosensitivity.

When a low molecular charge transport material is used, the amount thereof is preferably from 40 to 200 phr, and more preferably from 70 to 100 phr. When the high molecular charge transport material is used, a material obtained by copolymerizing 100 parts by mass of a charge transport component with 0 to 200 parts by mass, preferably about 80 to 150 parts by mass, of a resin component is preferably used.

To satisfy high sensitivity, it is preferable that the blending amount of the charge transport components is 70 phr or more. In addition, monomers and dimers of α-phenylstilbene compounds, benzidine compounds, and butadiene compounds as charge transport materials, as well as high molecular charge transport materials having these structures in the main chain or side chain, are useful for their high charge mobility.

The charge transport layer can be formed by dissolving or dispersing a mixture or copolymer containing charge transport components and binder components as the main components in a suitable solvent to prepare a coating material for the charge transport layer and applying the coating material, followed by drying. The coating method may be, for example, dipping, spray coating, ring coating, roll coater coating, gravure coating, nozzle coating, or screen printing.

Examples of the dispersion solvent for preparing the coating material for the charge transport layer include, but are not limited to: ketones such as methyl ethyl ketone, acetone, methyl isobutyl ketone, and cyclohexanone; ethers such as dioxane, tetrahydrofuran, and ethyl cellosolve; aromatics such as toluene and xylene; halogens such as chlorobenzene and dichloromethane; and esters such as ethyl acetate and butyl acetate. Among them, methyl ethyl ketone, tetrahydrofuran, and cyclohexanone are preferable because they have a lower degree of environmental impact as compared with chlorobenzene, dichloromethane, toluene, and xylene. Each of these solvents can be used alone or in combination with others.

Since the surface cross-linked resin layer is usually laminated on the charge transport layer, it is unnecessary to design the charge transport layer to be thicker in consideration of film scraping in practical use. The thickness of the charge transport layer is preferably from 10 to 40 μm, more preferably from 15 to 30 μm, for securing sensitivity and chargeability required for practical use.

If necessary, a low molecular compound such as an antioxidant, a plasticizer, a lubricant, and a ultraviolet absorber and a leveling agent can be further added to the charge transport layer. Each of these compounds can be used alone or in combination with others. When the low molecular compound and the leveling agent are used in combination, sensitivity deteriorates in many cases. Therefore, the combined amount of the low molecular compound and the leveling agent is preferably from 0.1 to 20 phr, and more preferably from 0.1 to 10 phr. The suitable amount of the leveling agent is from 0.001 to 0.1 phr.

Surface Layer

The electrophotographic photoconductor according to an embodiment of the present invention has a surface layer at the surface of the electrophotographic photoconductor.

Preferably, the surface layer is laminated on the charge transport layer. Preferably, the surface layer is comprised of a cured resin (also referred to as "cross-linked resin").

The surface layer contains fluororesin particles, non-fluororesin particles, and a cured resin.

The surface layer comprised of the cured resin (cross-linked resin) refers to a protective layer formed on the surface of the photoconductor. The protective layer is a resin film with a cross-linked structure formed by a polymerization reaction of a radical-polymerizable material conducted after the coating material has been applied. Among the layers composing the electrophotographic photoconductor, the surface layer (protective layer) is the most wear resistant since the resin film has a cross-linked structure. In addition, in a case in which a cross-linked charge transport structural unit is included, charge transportability similar to that of the charge transport layer is exhibited.

In the present disclosure, trimethylolpropane, which is also excellent in enhancing wear resistance of the photoconductor surface, can be suitably used.

Preferred examples of binder components which have three or more functional groups include, but are not limited to, caprolactone-modified dipentaerythritol hexaacrylate and dipentaerythritol hexaacrylate. These binder components can improve wear resistance and toughness of the cross-linked film itself.

Preferred examples of radical-polymerizable monomers having three or more functional groups and no charge transport structure include, but are not limited to, trimethylolpropane triacrylate, caprolactone-modified dipentaerythritol hexaacrylate, and dipentaerythritol hexaacrylate.

Commercial products thereof include those available from reagent manufacturers such as Tokyo Chemical Industry Co., Ltd. Specific examples thereof include KAYARD DPCA series and KAYARD DPHA series available from Nippon Kayaku Co., Ltd.

To accelerate or stabilize curing, an initiator, such as IRGACURE 184 manufactured by Ciba Specialty Chemicals, may be added in an amount about 5% to 10% by mass with respect to the total solid content.

Examples of cross-linkable charge transport materials include, but are not limited to, chain-polymerizable compounds having an acryloyloxy group or a styrene group and sequential-polymerizable compounds having a hydroxyl group, an alkoxysilyl group, or an isocyanate group. Compounds having a charge transport structure and one or more (meth)acryloyloxy groups can be used.

The surface cross-linked resin layer may have a composition in which a monomer or oligomer having one or more (meth)acryloyloxy groups containing no charge transport structure is used in combination.

The surface cross-linked resin layer may be formed by applying a coating liquid containing at least the above compounds to form a coated layer and cross-linking and curing the coated layer by imparting energy thereto by radiation such as heat, light, electron beam, and γ-ray.

Examples of the compound having a charge transport structure and one or more (meth)acryloyloxy groups include, but are not limited to, a charge transport compound represented by the following general formula 1.

General Formula 1

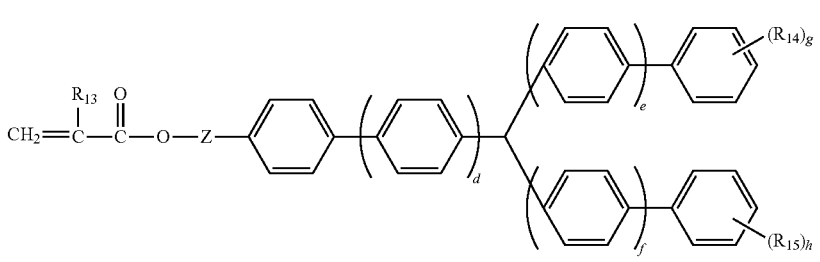

The film thickness of the surface layer is preferably 3 μm or more to maintain durability.

Cured Resin

The cured resin may be obtained by polymerizing a radical-polymerizable material component.

Examples of the radical-polymerizable material component include, but are not limited to, acrylates having an acryloyloxy group.

In the general formula 1, each of d, e, and f independently represents an integer of 0 or 1. $R_{13}$ represents a hydrogen atom or methyl group. Each of $R_{14}$ and $R_{15}$ is a substituent other than a hydrogen atom and independently represents an alkyl group having 1 to 6 carbon atoms. Each of g and h independently represents an integer of 0 to 3. Z represents a single bond, methylene group, ethylene group, or any of the following structures.

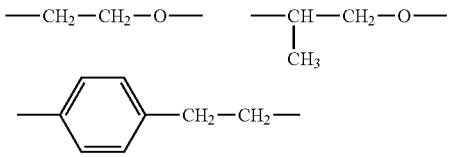

The surface cross-linked resin layer can be formed by applying a surface cross-linked resin layer coating material containing a radical-polymerizable material component and a solvent.

The solvent used to prepare the surface cross-linked resin layer coating material is preferably capable of sufficiently dissolving monomers. Specific examples of such solvents include, but are not limited to, ethers, aromatics, halogens, esters, cellosolves such as ethoxy ethanol, and propylene glycols such as 1-methoxy-2-propanol. Among them, methyl ethyl ketone, tetrahydrofuran, cyclohexanone, and 1-methoxy-2-propanol are preferable because they have a lower degree of environmental impact as compared with chlorobenzene, dichloromethane, toluene, and xylene. Each of these solvents can be used alone or in combination with others.

The coating method for the surface cross-linked resin layer coating material may be, for example, dipping, spray coating, ring coating, roll coater coating, gravure coating, nozzle coating, or screen printing. Since the coating material does not have a long pot life in many cases, coating methods which can form a required amount of coating with a small amount of coating material are advantageous in terms of environmental consideration and cost. Among the above coating methods, spray coating and ring coating are preferable.

The surface cross-linked resin layer may be formed by using a UV light source having a main light-emitting wavelength within the ultraviolet range, such as a high-pressure mercury lamp and a metal halide lamp. In addition, a visible light source may be selected in accordance with the absorption wavelength of the radical-polymerizable compound and/or a photopolymerization initiator. The amount of light irradiation is preferably from 50 to 1,000 mW/cm$^2$. When it is less than 50 mW/cm$^2$, a curing reaction takes time. When it is larger than 1,000 mW/cm$^2$, the reaction will progress in a non-uniform manner, thus causing local wrinkles on the surface of the surface cross-linked resin layer and generating a large number of unreacted residues and reaction-terminated ends. In addition, the internal stress is increased by rapid cross-linking, which causes cracks and film peeling.

If necessary, the low molecular compound such as an antioxidant, a plasticizer, a lubricant, and a ultraviolet absorber and a leveling agent, which can be added to the charge generation layer as described above, and the high molecular compound, which can be added to the charge transport layer as described above, can be further added to the surface cross-linked resin layer. Each of these compounds can be used alone or in combination with others. Since the combined use of the low molecular compound and the leveling agent may cause deterioration of sensitivity, the total amount of the low molecular compound and the leveling agent is preferably from 0.1% to 20% by mass, more preferably from 0.1% to 10% by mass, of the total solid content of the coating material. The amount of the leveling agent is preferably 0.1% to 5% by mass of the total solid content of the coating material.

The thickness of the surface cross-linked resin layer is preferably from 3 to 15 μm. The thickness may be 3 μm or more in view of the effect on the film formation cost and may be 15 μm or less in view of electrostatic characteristics such as charge stability and photosensitivity and uniformity in film quality.

Fluororesin Particles and Non-Fluororesin Particles

The surface layer (protective layer) contains fluororesin particles and non-fluororesin particles.

The surface layer (protective layer) is formed by dispersing fillers including fluororesin particles and non-fluororesin particles in a cured resin.

Examples of the fillers added to the protective layer include organic fillers and inorganic fillers.

Examples of the organic fillers include fluororesin fillers such as polytetrafluoroethylene. Examples of the organic fillers other than the fluororesin fillers include, but are not limited to, silicone resin fillers and carbon-based fillers.

Examples of the inorganic fillers include, but are not limited to: powders of metals such as copper, tin, aluminum, and indium; metal oxides such as silicon oxide, silica, aluminum oxide, tin oxide, zinc oxide, titanium oxide, indium oxide, antimony oxide, bismuth oxide, antimony-doped tin oxide, and tin-doped indium oxide; and inorganic materials such as potassium titanate.

Preferred examples of the non-fluororesin particles include inorganic materials and carbon-based fillers. Preferred examples of the inorganic materials include metal oxides. Among them, silicon oxide, aluminum oxide, and titanium oxide are particularly effective. Among the carbon-based fillers, diamond fillers are effective.

The fluororesin filler and the metal oxide particles may be used in combination.

According to an embodiment of the present invention, inclusion of fluororesin particles in the surface layer makes it easy to remove adherents from the surface of the photoconductor. On the other hand, inclusion of non-fluororesin particles makes it possible to enhance frictional force between a cleaning blade and the photoconductor. Combined use of fluororesin particles with non-fluororesin particles is expected to keep the surface of the photoconductor clean without scraping the surface.

The mixing ratio of the fluororesin particles to the non-fluororesin particles is preferably from 0.1/100 to 100/100, and more preferably from 1/100 to 50/100.

According to an embodiment of the present invention, the average particle diameter of the fluororesin particles is preferably from 0.01 to 0.3 μm. The average particle diameter of the non-fluororesin particles is preferably from 0.1 to 1.0 μm.

The higher the filler concentration in the protective layer, the higher the wear resistance but the lower the transmittance of writing light, which may cause side effects. Therefore, the content thereof is preferably 50% by mass or less, and more preferably 30% by mass or less, based on the total solid content. The lower limit of the content is preferably 5% by mass.

The film thickness of the protective layer in which fillers are dispersed in a cured resin is preferably from 0.5 to 10 μm, and more preferably from 1.0 to 6.0 μm.

Cross-Sectional Image of Surface Layer Observed by SEM

In the present disclosure, the average particle diameter of the fluororesin particles and that of the non-fluororesin particles in the surface layer are determined from a cross-sectional image of the surface layer observed by a scanning electron microscope (SEM). In addition, the dispersion states of the fluororesin particles and the non-fluororesin particles in the surface layer are evaluated using the cross-sectional image of the surface layer observed by SEM (hereinafter may be referred to as "SEM image"). In the present disclosure, the cross-sectional image of the surface layer is observed by SEM at a magnification of 5,000 times.

In the cross-sectional image of the surface layer observed by SEM, the fluororesin particles contained in the surface layer has an average particle diameter of from 0.01 to 0.3 μm.

In addition, in the cross-sectional image of the surface layer observed by SEM, the non-fluororesin particles contained in the surface layer preferably has an average particle diameter of from 0.1 to 1.0 μm.

In the present disclosure, the dispersion states of the fluororesin particles and the non-fluororesin particles in the surface layer are evaluated in the following manner.

The SEM image is divided into 1 μm×4 μm regions, and the area occupied by the fluororesin particles and the non-fluororesin particles in each region is calculated. As a result, in the electrophotographic photoconductor according to an embodiment of the present invention, the standard deviation of the areas each of which is occupied by the fluororesin particles and the non-fluororesin particles in each region is 0.2 $\mu m^2$ or less.

Furthermore, it is preferable that the standard deviation of areas each of which is occupied by the fluororesin particles in each region is 0.15 $\mu m^2$ or less.

Furthermore, it is preferable that the standard deviation of areas each of which is occupied by the non-fluororesin particles in each region is 0.15 $\mu m^2$ or less.

To form preferable dispersion states of the fluororesin particles and the non-fluororesin particles in the surface layer, a dispersion liquid of the fluororesin particles used to form the surface layer preferably contains cyclopentanone as a dispersion medium and a fluorine-based surfactant.

It is preferable that the proportion of the fluorine-based surfactant to the fluororesin particles is from 0.1% to 20%.

Observation of Surface Layer by SEM

A procedure for observing the fluororesin particles and the non-fluororesin particles in the surface layer is described below.

The average particle diameter, number, and area ratio of the particles can be determined by photographing a cross-sectional image of the surface of the electrophotographic photoconductor by SEM and analyzing the particles displayed in the image.

Since the image obtained by SEM is a projected image from the substantially vertical direction with respect to the surface, the displayed image of particles is also a projected image in the vertical direction.

The image thus obtained is analyzed with an image analysis device or image analysis software.

Examples of the image analysis device include, but are not limited to: dedicated instruments such as a high-detail image analysis system IP-1000 (available from ASAHI ENGINEERING CO., LTD.); and computers to which an image analysis software program such as IMAGE-PRO PLUS (available from NIPPON ROPER K.K.) and image) (distributed by the National Institutes of Health of the United States) is introduced.

These instruments are capable of binarizing the image into a particle portion and a non-particle portion and calculating the area ratio of each portion.

The fluororesin particles and the non-fluororesin particles can be discriminated by an analysis based on SEM-EDS (scanning electron microscope—energy dispersive X-ray spectrometry). Discrimination is also possible from the color difference in the SEM image.

When the acceleration voltage of SEM is high, an internal state near the surface can be obtained as image information.

Therefore, the acceleration voltage needs to be adjusted so that the particles exposed on the surface are displayed.

For example, when a field emission scanning electron microscope S-4200 (manufactured by Hitachi, Ltd.) is used, the acceleration voltage is preferably set to about 2 to 6 kv. The acceleration voltage may be suitably adjusted depending on the apparatus and the material of the electrophotographic photoconductor.

The cross-sectional image of the surface layer thus obtained by SEM is incorporated by the image analysis software program, to calculate the average particle diameter and area ratio of the particles within the observed range, thus obtaining the state of the particles in the surface layer of the photoconductor.

One specific procedure is described below.

An image is acquired by a field emission scanning electron microscope S-4200 (manufactured by Hitachi, Ltd.) at a magnification of 5,000 times and an acceleration voltage of 8 kV.

The image thus acquired is binarized into a particle portion and a non-particle portion with an image analysis software program imageJ.

The area ratio between the binarized portions can be calculated with the same software.

For more detailed observation, a hot cathode field emission scanning electron microscope (also referred to as "thermal FE-SEM") can also be used.

The thermal FE-SEM enables observation at high resolution because the luminance of the electron gun serving as a light source is several hundred times that of the thermal electron gun of normal SEM.

In the Examples described later, a thermal FE-SEM was used to observe a cross-sectional state of the particles present in the cured protective layer.

A specific procedure for the observation method using thermal FE-SEM is described below, but is not limited thereto.

First, a platinum palladium coating is formed on a fragment of the surface layer of the electrophotographic photoconductor to impart conductivity, and then platinum carbon is deposited thereon for surface protection, thus preparing an observation sample.

Next, the sample is subjected to a cross-sectioning processing with a focused ion beam (FIB) and then observed with a thermal FE-SEM.

Examples of the FIB apparatus include QUANTA 200 3D (manufactured by FEI Company Japan Ltd.). Examples of the thermal FE-SEM include ULTRA 55 (manufactured by Carl Zeiss AG).

Calculation of Average Particle Diameter of Particles and Area Ratio of Particles in Each Region in Cross-Sectional Image Observed by SEM The calculation of the average particle diameter of the particles in the surface layer of the electrophotographic photoconductor and the area ratio of the particles in each segmented region in a cross-sectional image of the surface layer is described below.

FIG. 1A is a cross-sectional image of the surface layer of the electrophotographic photoconductor observed by SEM.

Figure 1B:
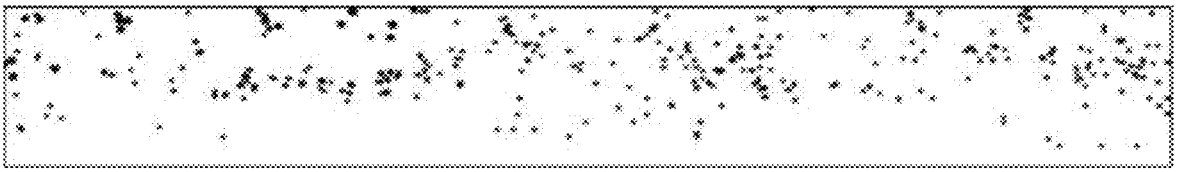
FIG. 1B is an image of fluororesin particles extracted from the image of FIG. 1A observed by SEM.
Figure 1C:
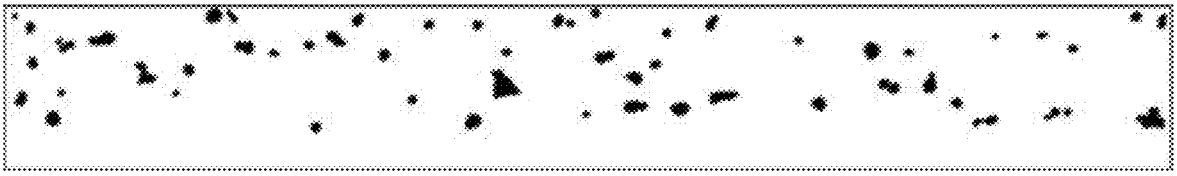
FIG. 1C is an image of non-fluororesin particles extracted from the image of FIG. 1A observed by SEM.

Specifically, FIG. 1A is a tiff image acquired from a cross-sectional image of the surface layer of the electrophotographic photoconductor containing the fluororesin particles, non-fluororesin particles, and cured resin, at a portion where these particles are contained, observed by SEM at a magnification of 5,000 times. This image gets provided with scale information with reference to a scale bar, then enhanced in contrast if necessary, and converted into an 8-bit image (Type 8-bit), by an image analysis software program imageJ. The threshold of image density can be adjusted such that the image of the fluororesin particles are extracted from the original image. The resulting image is illustrated in FIG. 1B. FIG. 1B is an image of the fluororesin particles extracted from the SEM image of FIG. 1A. Similarly, the threshold of image density can be adjusted such that the image of the non-fluororesin particles are extracted from the original image. The resulting image is illustrated in FIG. 1C. FIG. 1B is an image of the non-fluororesin particles extracted from the SEM image of FIG. 1A. Information of the particles present in the surface layer is acquired by performing the Analyze Particle command of imageJ for FIGS. 1B and 1C.

The area of each particle is measured to calculate the equivalent circle diameter. The average particle diameter of the particles is determined from the calculated equivalent circle diameters of the particles. The average particle diameter is determined based on the measurement results for at least 20 particles.

Figure 2:
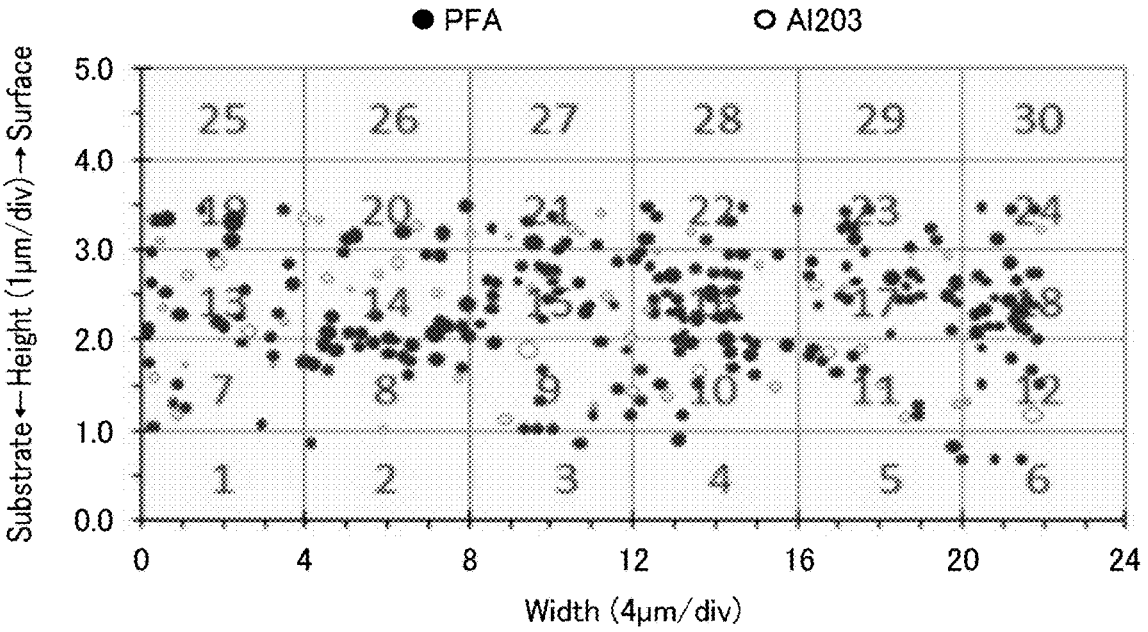
FIG. 2 is a chart derived from a cross-sectional image of a surface layer of an electrophotographic photoconductor according to an embodiment of the present invention observed by SEM, segmented into uniform regions each being 1 μm×4 μm to show the positions and areas occupied by the fluororesin particles and the non-fluororesin particles in each region.
Figure 3:
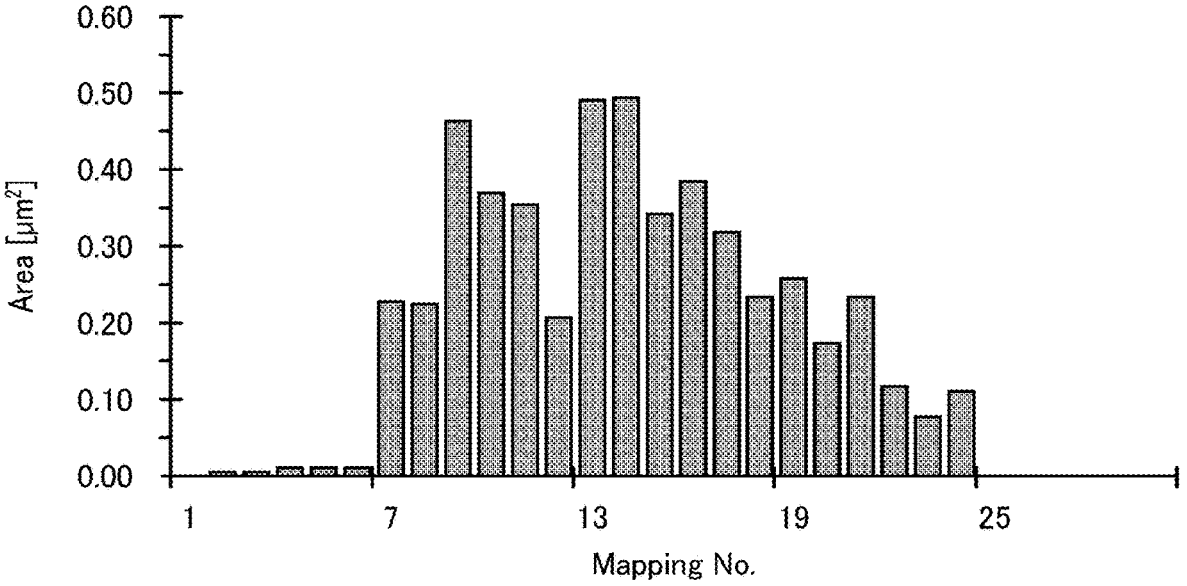
FIG. 3 is a graph showing the area occupied by the fluororesin particles and the non-fluororesin particles in each region in the chart of FIG. 2.

As particle information, longitudinal and lateral position information and area information are obtained. The image is segmented into uniform regions each having a longitudinal length of 1 μm and a lateral length of 4 μm, and the area occupied by the particles in each region is calculated. Description is made below with reference to FIGS. 2 and 3. FIG. 2 is a chart derived from a cross-sectional image of the surface layer of the electrophotographic photoconductor according to an embodiment of the present invention observed by SEM, segmented into uniform regions each being 1 μm×4 μm to show the positions and areas occupied by the fluororesin particles and the non-fluororesin particles in each region. FIG. 3 is a graph showing the area occupied by the fluororesin particles and the non-fluororesin particles in each region in the chart of FIG. 2.

The area occupied by the fluororesin particles and the non-fluororesin particles in each region is calculated as shown in the graph of FIG. 3, then the standard deviation of the areas each of which is occupied by the fluororesin particles and the non-fluororesin particles in each region is calculated.

Referring to FIG. 3, the standard deviation is calculated based on 18 regions with Nos. 7 to 24 shown in FIG. 2. As seen above, the standard deviation is calculated based on the regions in which the fluororesin particles and the non-fluororesin particles are contained in a predetermined amount or more (at least an amount worth calculating the standard deviation). For example, regions in each of which the random variable ranges from 0.25 to 0.75 in the probability distribution may be extracted. In this case, referring to FIGS. 2 and 3, the regions with Nos. 2 to 6 are not used to calculate the standard deviation.

In the case of segmenting the SEM image of the surface layer into uniform regions each being 1 μm×4 μm, the number of regions used to calculate the standard deviation can be appropriately selected depending on the types of particles and resin that constitute the surface layer and the mixing ratio thereof. However, as shown in FIGS. 2 and 3, it is preferable that the standard deviation is calculated based on around 18 regions.

Alternatively, it is preferable that the standard deviation is calculated based on 1 μm×4 μm regions present in a portion 1.5 to 4 μm inside (charge transport layer side) of the surface of the surface layer of the electrophotographic photoconductor.

Image Forming Apparatus and Image Forming Method

The electrophotographic photoconductor is used to form an image.

The image forming apparatus according to an embodiment of the present invention includes the electrophotographic photoconductor according to an embodiment of the present invention and a lubricant supply device configured to supply a lubricant to the electrophotographic photoconductor.

The image forming method according to an embodiment of the present invention includes the process of supplying a lubricant to the electrophotographic photoconductor ("lubricant supply process").

The image forming apparatus according to an embodiment of the present invention performs the image forming method according to an embodiment of the present invention. The image forming method according to an embodiment of the present invention is performed by the image forming apparatus according to an embodiment of the present invention. Therefore, the image forming method according to an embodiment of the present invention can be clarified through the description of the image forming apparatus according to an embodiment of the present invention.

Lubricant Supply Device

The image forming apparatus according to an embodiment of the present invention includes a lubricant supply device configured to supply a lubricant to the electrophotographic photoconductor.

It is preferable for the image forming apparatus to use a lubricant to reduce wear of the photoconductor and to maintain cleanability of the surface of the photoconductor.

Lubricant

Preferred examples of the lubricant include waxes and higher fatty acid metal salts.

Specific examples of the waxes include, but are not limited to; plant waxes such as Japanese wax, lacquer wax, palm wax, and carnauba wax; animal waxes such as bees wax, spermaceti, insect wax, and wool wax; and mineral waxes such as montan wax and paraffin wax.

Many higher fatty acid metal salts can be effectively used for their properties. Among them, zinc stearate is a compound capable of taking a lamellar structure. The lamellar structure is formed with stacked layers in each of which molecule chains are regularly folded. The lamellar structure is a layered structure in which amphiphilic molecules are self-organized. When a shear force is applied thereto, it is likely that crystals are broken and separated along the layers. This action is effective in establishing circulation of the lubricant.

Zinc stearate under a shear force uniformly covers the surface of the photoconductor due to the properties of the lamellar structure, which makes it possible to effectively cover the surface of the photoconductor with a small amount of lubricant. When a lubricant is applied by this way, there are various methods for controlling the application state of the lubricant. For example, the contact pressure between a solid lubricant and an application brush may be increased or the rotational speed of the application brush may be controlled. Also, there is an attempt to control the number of rotations of the application brush in accordance with image formation information.

The lubricant may be a wax or higher fatty acid metal salt alone. Alternatively, the lubricant as a binder may be mixed with other functional materials such as a charge transport material and an antioxidant.

The lubricant is selected from materials which are easy to form a film and to remove in an image forming apparatus. Therefore, it is easy to achieve equivalence in the amount of the lubricant even during repeated processes of removing and coating of the lubricant. This makes it possible to simplify the module for applying and removing the lubricant. In addition, it is possible to form a film of the lubricant for an extended period of time. Furthermore, by combining with the shape of the surface layer, the coating capacity per cycle can be remarkably enhanced and the consumption rate of the lubricant can be reduced.

Preferred examples of the lubricant further include fatty acid metal salts capable of taking a lamellar structure. Examples of the fatty acid metal salts capable of taking a lamellar structure include, but are not limited to, those containing one or more fatty acids (e.g., stearic acid, palmitic acid, myristic acid, and oleic acid) and one or more metals (e.g., zinc, aluminum, calcium, magnesium, and lithium).

More specific examples of the lubricant include, but are not limited to: fatty acid metal salts such as lead oleate, zinc oleate, copper oleate, zinc stearate, cobalt stearate, iron stearate, copper stearate, zinc palmitate, copper palmitate, and zinc linolenate; and fluorine-based resins such as polytetrafluoroethylene, polychlorotrifluoroethylene, polyvinylidene fluoride, polytrifluorochloroethylene, dichlorodifluoroethylene, tetrafluoroethylene-ethylene copolymer, and tetrafluoroethylene-oxafluoropropylene copolymer. In particular, materials capable of taking a lamellar structure have high circulation efficiency, and zinc stearate is advantageous in cost. Also preferred is a mixture of zinc stearate and zinc palmitate.

Zinc stearate is the most preferable material in terms of cost, quality, stability, and reliability since it has been produced on an industrial scale and widely used in various fields. In addition, zinc stearate has the advantage of being easy to apply the abundant application technologies which have conventionally been accumulated as efficient application method for lubricants. It is to be noted that higher fatty acid metal salts generally used industrially are not composed only of their single compound represented by their name, but contain more or less other similar fatty acid metal salts, metal oxides, or free fatty acids. The same applies for the fatty acid metal salts according to an embodiment of the present invention.

The above-described lubricant provides high reliability and cost reduction in forming a film thereof. In addition, the above-described lubricant provides convenience in developing devices which are easy to apply the accumulated application technologies for lubricants.

Embodiments of Image Forming Apparatus

Example configurations of the image forming apparatus are described below with reference to the drawings. In the following embodiments, the lubricant supply device is mounted on the image forming apparatus.

Figure 4:
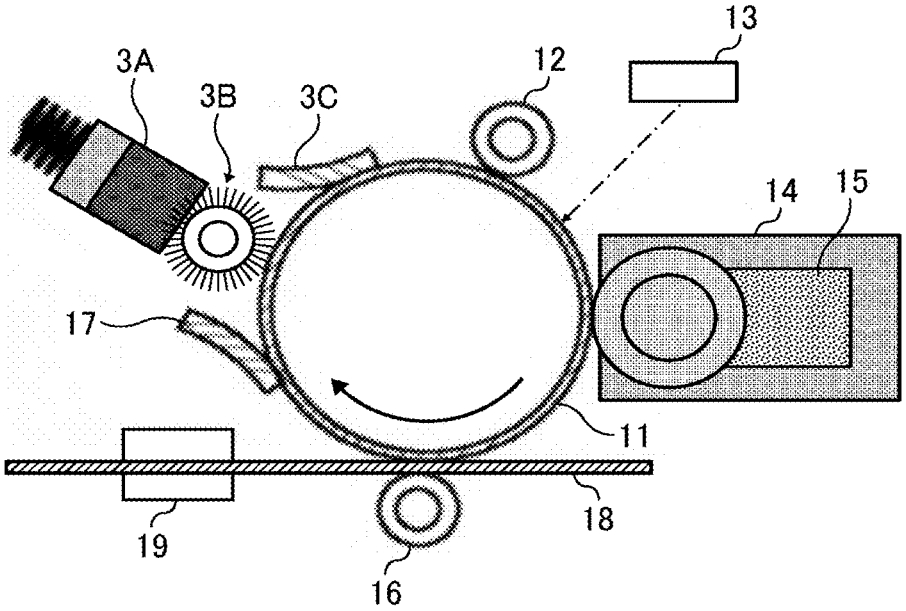
FIG. 4 is a schematic view of an image forming apparatus according to an embodiment of the present invention.

FIG. 4 is a schematic view of an image forming apparatus according to an embodiment of the present invention.

An electrophotographic photoconductor 11 illustrated in FIG. 4 has a surface layer containing fluororesin particles, non-fluororesin particles, and a cured resin.

In a cross-sectional image of the surface layer observed by SEM at a magnification of 5,000 times, the fluororesin particles have an average particle diameter of from 0.01 to 0.3 μm.

When the cross-sectional image observed by SEM is segmented into uniform regions each being 1 μm×4 μm and the area occupied by the fluororesin particles and the non-fluororesin particles in each region is calculated, the standard deviation of the areas each of which is occupied by the fluororesin particles and the non-fluororesin particles in each region is 0.2 $\mu m^2$ or less.

The electrophotographic photoconductor 11 has a drum-like shape, but may also be in a sheet-like shape or an endless-belt-like shape.

A charging device 12 is configured to uniformly charge the surface of the electrophotographic photoconductor 11. Specific examples thereof include known devices such as a corotron, a scorotron, a solid state charger, and a charging roller. The charging device 12 is preferably in contact with or in proximity to the electrophotographic photoconductor 11 for reduction of power consumption. In particular, to prevent contamination of the charging device 12, a charging mechanism is preferably disposed in proximity to the electrophotographic photoconductor 11 forming an appropriate gap between the electrophotographic photoconductor 11 and the surface of the charging device 12. Generally, the above-described charger can also be used for a transfer device 16, but a combination of a transfer charger and a separation charger is more effective therefor.

The light source used for an exposure device 13 or an electric charge removing device (1A in FIG. 5) in another embodiment may be luminous matter such as fluorescent lamp, tungsten lamp, halogen lamp, mercury lamp, sodium lamp, light emitting diode (LED), semiconductor laser (LD), and electroluminescence (EL). For the purpose of emitting only light having a desired wavelength, any type of filter can be used, such as sharp cut filter, band pass filter, near infrared cut filter, dichroic filter, interference filter, and color-temperature conversion filter.

A toner 15 is developed on the electrophotographic photoconductor 11 by a developing device 14 and transferred onto a print medium 18 such as a printing sheet or a slide for overhead projectors. Not all the toner particles are transferred and some of them remain on the electrophotographic photoconductor. Such residual toner particles are removed from the electrophotographic photoconductor 11 by a cleaning device 17. The cleaning device 17 may by a rubber cleaning blade or a brush such as a fur brush and a magnetic fur brush.

When the electrophotographic photoconductor 11 is positively (negatively) charged by the charging device 12 and exposed to light containing image information by the exposure device 13, a positive (negative) electrostatic latent image is formed on the surface of the electrophotographic photoconductor 11. When this electrostatic latent image is developed with a toner of negative (positive) polarity by the developing device 14, a positive image is obtained. When it is developed with a toner of positive (negative) polarity, a negative image is obtained. The developing device 14 is applied with a known method, and the electric charge removing device is also applied with a known method.

A toner image developed on the print medium 18 is conveyed to a fixing device 19 from a position where the electrophotographic photoconductor 11 and the transfer device 16 face each other, and is fixed on the print medium 18 by the fixing device 19.

A lubricant 3A, an application brush 3B for applying the lubricant, and an application blade 3C are disposed downstream of the cleaning device 17 and upstream of the charging device 12 in the direction of rotation of the electrophotographic photoconductor 11. This arrangement relationship is the same in the other embodiments described below.

Figure 5:
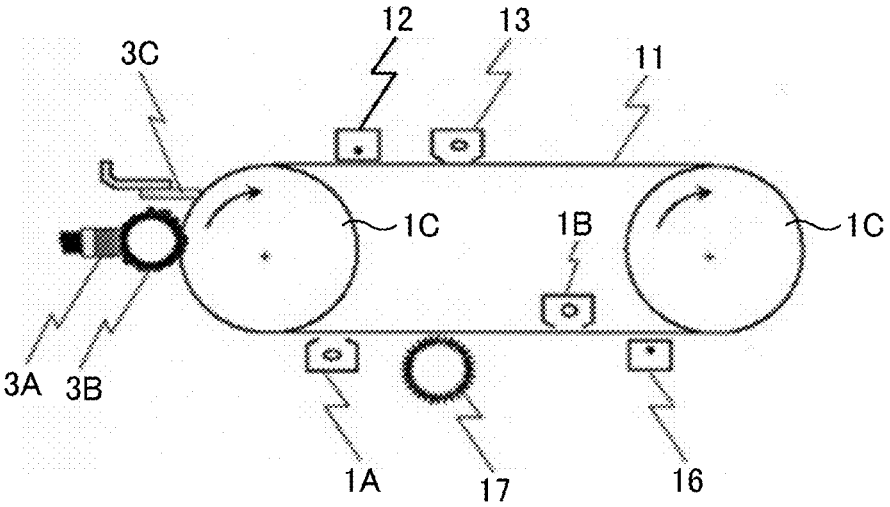
FIG. 5 is a schematic view of an image forming apparatus according to an embodiment of the present invention.

FIG. 5 is a schematic view of an image forming apparatus according to another embodiment of the present invention. An electrophotographic photoconductor 11 is driven by drivers 1C and repeatedly subjected to charging by a charging device 12, image exposure by an exposure device 13, image development, transfer by a transfer device 16, pre-cleaning exposure by a pre-cleaning exposure device 1B, cleaning by a cleaning device 17, and electric charge removal by an electric charge removing device 1A. A lubricant 3A, an application brush 3B for applying the lubricant, and an application blade 3C are disposed between the cleaning device 17 and the charging device 12 in the direction of movement of the electrophotographic photoconductor 11.

In FIG. 5, light emission for the pre-cleaning exposure is performed from the substrate side of the electrophotographic photoconductor 11 (in this case, the substrate is translucent).

The above-described electrophotographic process is just an example. Although the pre-cleaning exposure is performed from the substrate side in FIG. 5, this may be performed from the photosensitive layer side. The image exposure and light emission for the electric charge removal may be performed from the substrate side. The image exposure, pre-cleaning exposure, and electric charge removal exposure are illustrated as light emission processes. In addition, the electrophotographic photoconductor may be further subjected to pre-transfer exposure, pre-exposure for image exposure, and other known light emission processes.

Figure 6:
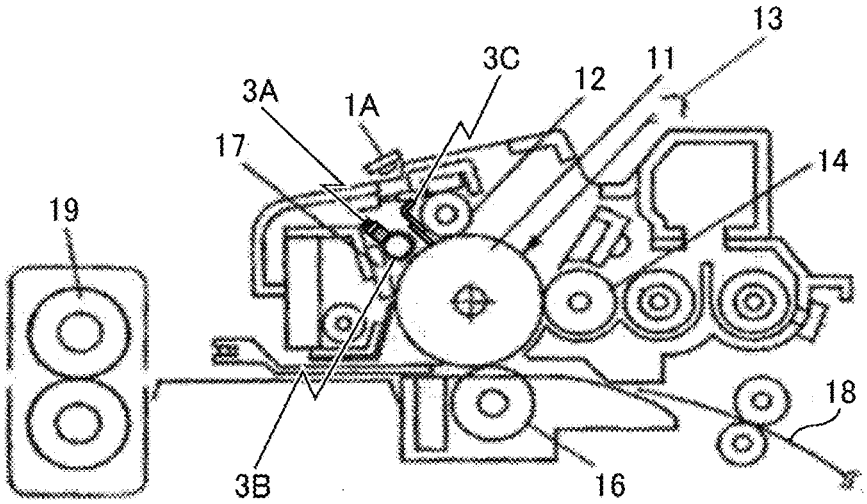
FIG. 6 is a schematic view of a process cartridge according to an embodiment of the present invention.

The above-described devices for image formation may be fixedly incorporated in a copier, a facsimile machine, or a printer, and may also be incorporated in such apparatuses in the form of a process cartridge. The process cartridge may be in a variety of shapes. One example thereof is illustrated in FIG. 6. The electrophotographic photoconductor 11 has a drum-like shape, but may also be in a sheet-like shape or an endless-belt-like shape.

The process cartridge includes at least an electrophotographic photoconductor configured to bear an electrostatic latent image, a developing device configured to develop the electrostatic latent image on the electrophotographic photoconductor with toner to form a visible image, and a lubricant supply device configured to supply the toner onto the electrophotographic photoconductor. The process cartridge may further include other devices such as a charging device, an exposure device, a transfer device, a cleaning device, and a charge removing device, appropriately selected according to the need.

The developing device includes at least a developer container containing a toner or developer, and a developer bearer configured to bear and convey the toner or developer contained in the developer container. The developing device may further include a layer thickness regulator configured to regulate the layer thickness of the toner borne by the developer bearer.

The process cartridge is detachably mountable on various electrophotographic image forming apparatuses, facsimile machines, and printers. Particularly preferably, the process cartridge is detachably mounted on the image forming apparatus according to an embodiment of the present invention.

Figure 7:
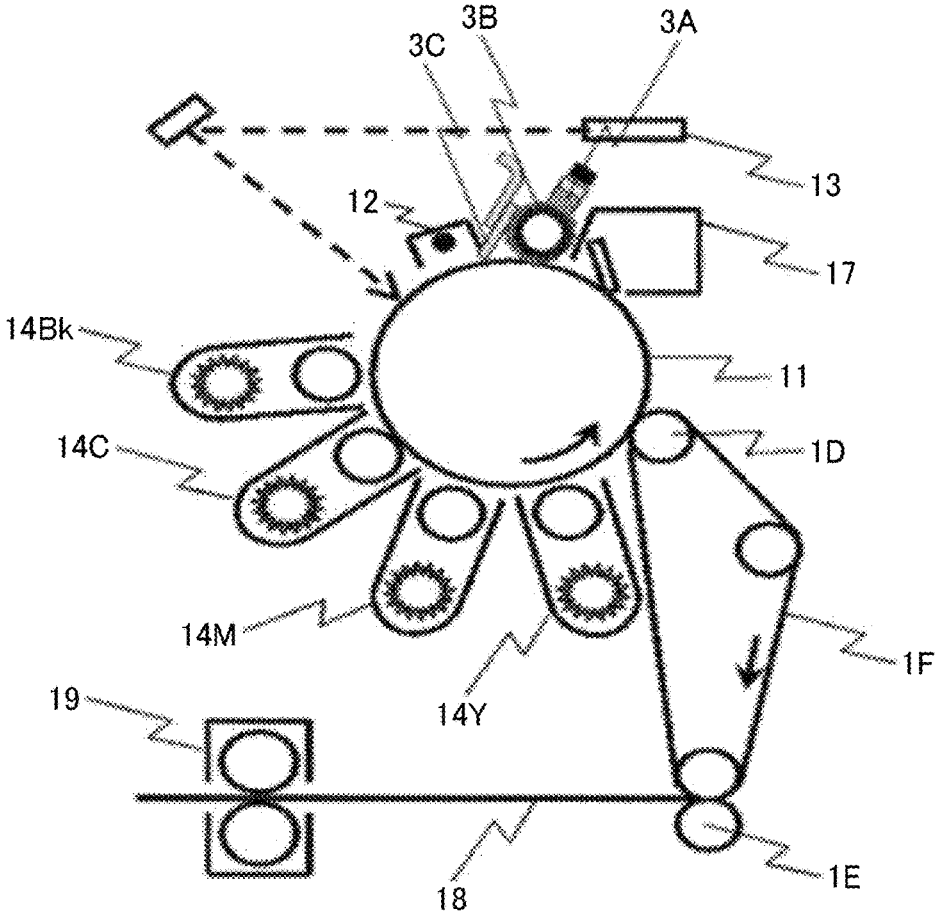
FIG. 7 is a schematic view of an image forming apparatus according to an embodiment of the present invention.

FIG. 7 is a schematic view of an image forming apparatus according to another embodiment of the present invention. In this image forming apparatus, a charging device 12, an exposure device 13, developing devices 14Bk, 14C, 14M, and 14Y for respective colors of black (Bk), cyan (C), magenta (M), and yellow (Y), an intermediate transfer belt 1F as an intermediate transferor, and a cleaning device 17, in this order, are disposed around the electrophotographic photoconductor 11.

In FIG. 7, the suffixes (Bk, C, M, and Y) correspond to the colors of the toners and are appropriately omitted as necessary. The electrophotographic photoconductor 11 may have a Vickers hardness of from 31 to 870 HV (test force: 0.25 mN, holding time: 30 sec) and a surface free energy of from 20 to 78 $mJ/m^2$. The developing devices 14Bk, 14C, 14M, and 14Y can be independently controlled, and only the developing devices of the colors used to form an image are driven. A toner image formed on the electrophotographic photoconductor 11 is transferred onto the intermediate transfer belt 1F by a first transfer device 1D disposed inside the loop of the intermediate transfer belt 1F.

The first transfer device 1D is disposed so as to be capable of coming into and coming out of contact with the electrophotographic photoconductor 11, and brings the intermediate transfer belt 1F into contact with the electrophotographic photoconductor 11 only during the transfer operation. Each color image formation is sequentially performed, then the toner images superimposed on the intermediate transfer belt 1F are collectively transferred onto a print medium 18 by a second transfer device 1E and fixed by a fixing device 19 to form an image.

The second transfer device 1E is also disposed so as to be capable of coming into and coming out of contact with the intermediate transfer belt 1F, and comes into contact with the intermediate transfer belt 1F only during the transfer operation.

In an image forming apparatus employing a transfer drum system, color toner images are sequentially transferred onto a print medium that is electrostatically attracted to the transfer drum. Therefore, there is a limitation on the print medium that thick paper cannot be used. On the other hand, in the image forming apparatus employing an intermediate transfer system as illustrated in FIG. 7, color toner images are superimposed on the intermediate transfer belt 1F, so that there is no limitation on the printing medium. Such an intermediate transfer system can be applied not only to the apparatus illustrated in FIG. 7 but also to the above-described image forming apparatuses illustrated in FIGS. 4, 5, and 6 and the below-described image forming apparatuses illustrated in FIGS. 8 and 9.

A lubricant 3A, an application brush 3B for applying the lubricant, and an application blade 3C are disposed between the cleaning device 17 and the charging device 12 in the direction of rotation of the electrophotographic photoconductor 11.

Figure 8:
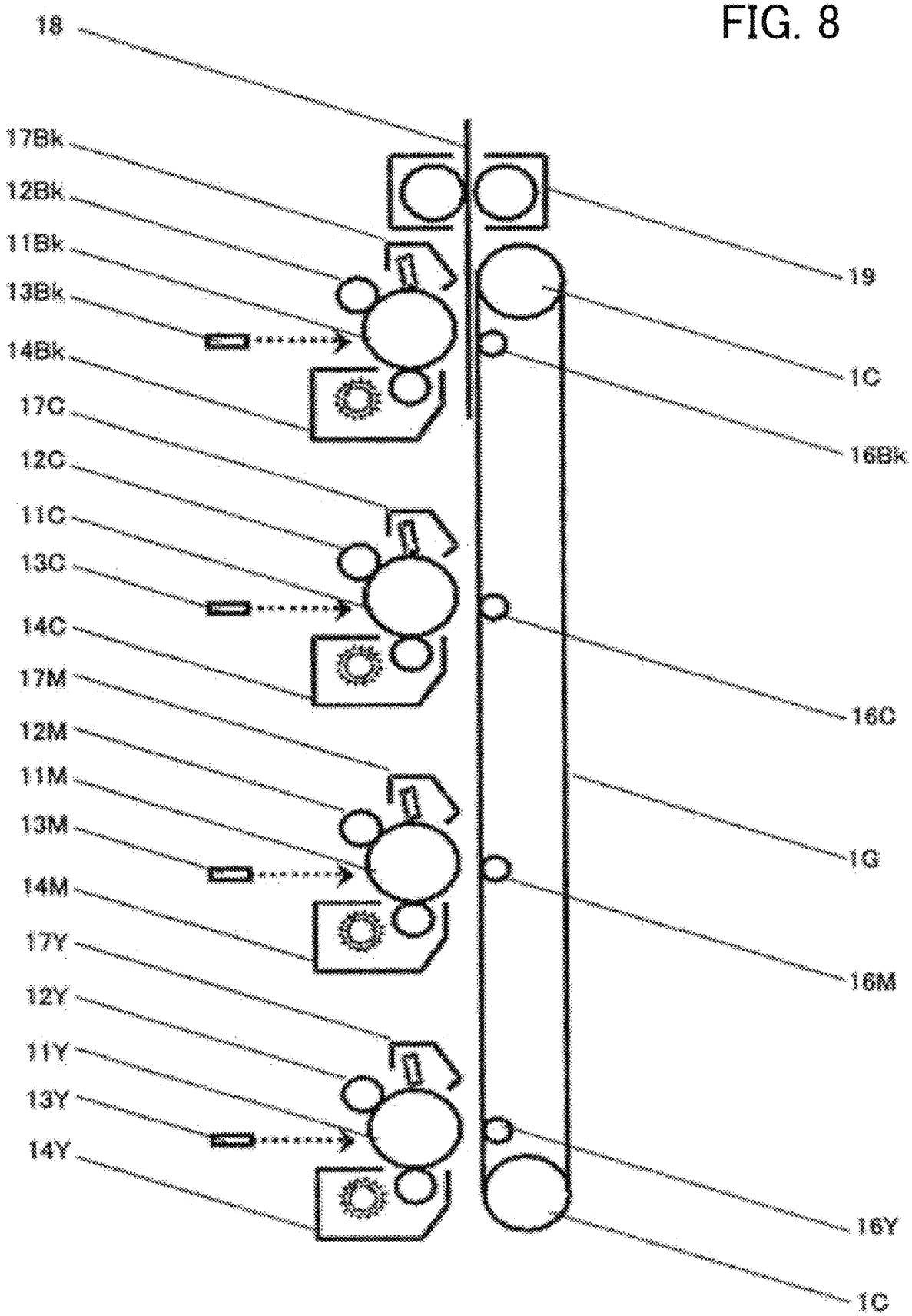
FIG. 8 is a schematic view of an image forming apparatus according to an embodiment of the present invention.

FIG. 8 is a schematic view of an image forming apparatus according to another embodiment of the present invention. This image forming apparatus includes four image forming units using respective toners of yellow (Y), magenta (M), cyan (C), and black (Bk). The image forming units further include respective electrophotographic photoconductors 11Y, 11M, 11C, and 11Bk. Around the electrophotographic photoconductors 11Y, 11M, 11C, and 11Bk, respective charging devices 12Y, 12M, 12C, and 12Bk, respective exposure devices 13Y, 13M, 13C, and 13Bk, respective developing devices 14Y, 14M, 14C, and 14Bk, and respective cleaning devices 17Y, 17M, 17C, and 17Bk are disposed.

A conveyance transfer belt 1G as a transfer material bearer, configured to come into contact with and come out of contact with transfer positions of the electrophotographic photoconductors 11Y, 11M, 11C, and 11Bk arranged in tandem, is stretched over drivers 1C. Transfer devices 16Y, 16M, 16C, and 16Bk are disposed at the transfer positions facing the respective electrophotographic photoconductors 11Y, 11M, 11C, and 11Bk with the conveyance transfer belt 1G interposed therebetween.

In the image forming apparatus employing a tandem system illustrated in FIG. 8, Y, M, C, and Bk toner images formed on the respective electrophotographic photoconductors 11Y, 11M, 11C, and 11Bk are sequentially transferred onto a print medium 18 held by the conveyance transfer belt 1G. Compared to a full-color image forming apparatus having only one electrophotographic photoconductor, this image forming apparatus is able to output a full color image at a much higher speed. A composite toner image developed on the print medium 18 as a transfer material is conveyed to a fixing device 19 from a position where the electrophotographic photoconductor 11Bk and the transfer device 16Bk face each other, and is fixed on the print medium 18 by the fixing device 19.

Figure 9:
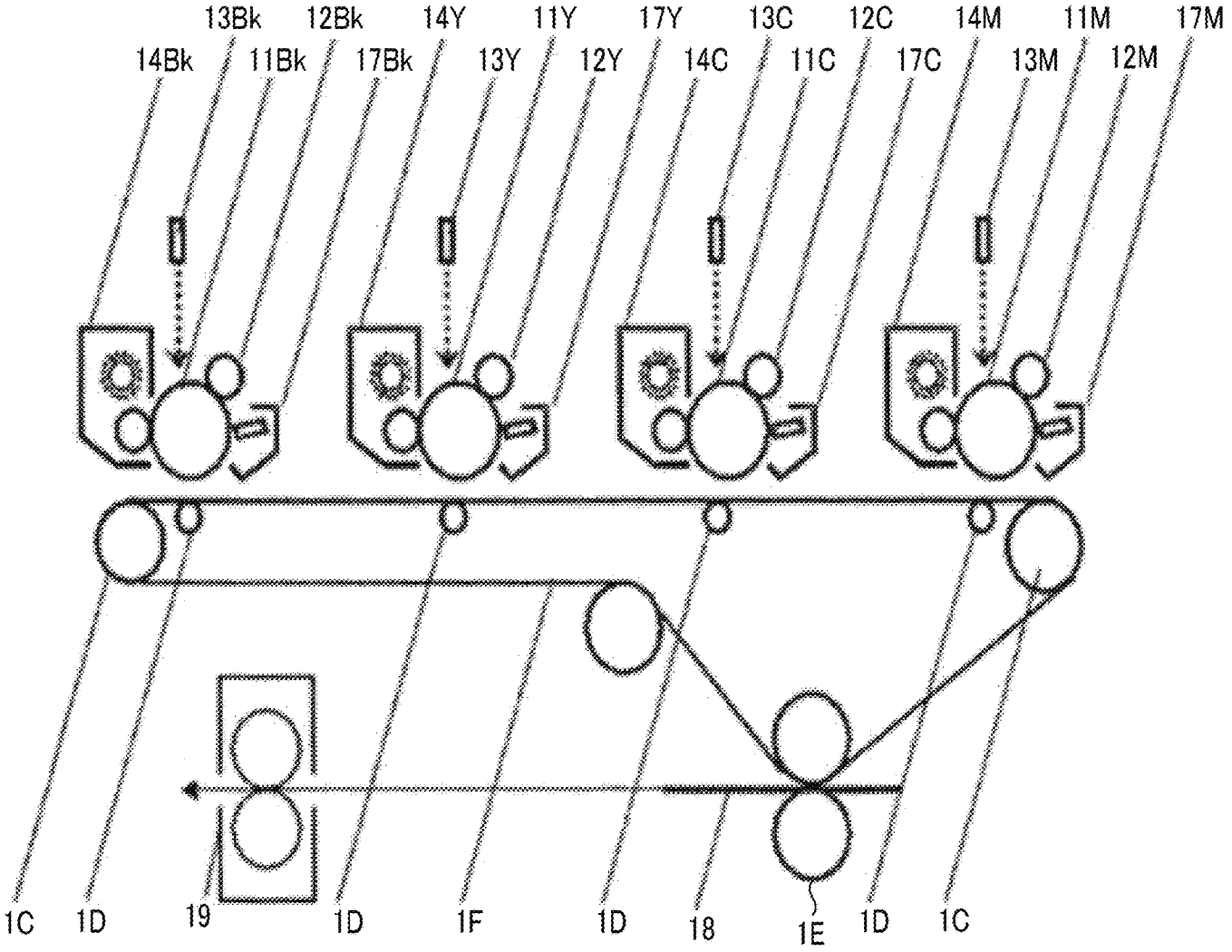
FIG. 9 is a schematic view of an image forming apparatus according to an embodiment of the present invention.

Also, this image forming apparatus may employ a configuration illustrated in FIG. 9. That is, the direct transfer system using the conveyance transfer belt 1G illustrated in FIG. 8 can be replaced with another system using an intermediate transfer belt 1F illustrated in FIG. 9.

In the configuration illustrated in FIG. 9, Y, M, C, and Bk toner images formed on the respective electrophotographic photoconductors 11Y, 11M, 11C, and 11Bk are sequentially transferred and stacked on an intermediate transfer belt 1F stretched over and driven by the drivers 1C by the first transfer devices 1D serving as primary transferors to form a full-color image.

Subsequently, the intermediate transfer belt 1F is further driven, and the full-color image held by the intermediate transfer belt 1F is conveyed to a position where a second transfer device 1E as a secondary transferor and a roller disposed opposite to the second transfer device 1E face each other. Then, the full-color image is secondarily transferred onto a print medium 18 as the transfer material by the second transfer device 1E to form a desired image on the transfer material.

Embodiments of Lubricant Supply Device

Example configurations of the lubricant supply device are described below with reference to the drawings.

Figure 10:
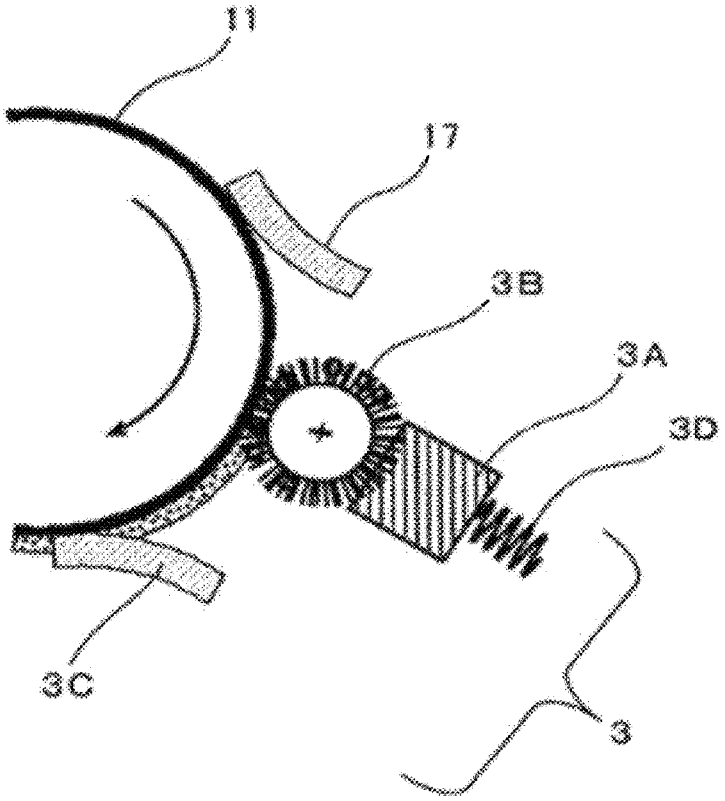
FIG. 10 is a schematic view of a lubricant supply device according to an embodiment of the present invention.

All of the above-described image forming apparatuses include a lubricant application device 3, illustrated in FIG. 10, as the lubricant supply device configured to supply a lubricant 3A to the surface of an electrophotographic photoconductor 11. The lubricant application device 3 includes an application brush (fur brush) 3B as an application member, a lubricant 3A, a pressure spring 3D for pressing the lubricant toward the fur brush, and an application blade 3C for regulating or leveling the lubricant 3A.

The lubricant 3A is a lubricant molded into a bar shape. The brush tip of the fur brush 3B is in contact with the surface of the electrophotographic photoconductor. As the fur brush 3B rotates around the axis, the lubricant 3A is once drawn up to the brush, then carried and conveyed to the contact position of the fur brush 3B with the surface of the electrophotographic photoconductor 11, and applied onto the surface of the electrophotographic photoconductor 11.

The lubricant 3A is pressed toward the fur brush 3B at a predetermined pressure by the pressure spring 3D, so that the lubricant 3A is kept in contact with the fur brush 3B even when the lubricant 3A has been scraped off by the fur brush 3B and reduced in volume over time. As a result, even a minute amount of the lubricant 3A can be constantly and uniformly drawn up to the fur brush 3B.

In addition, a lubricant supply device configured to form a coating of the lubricant 3A on the surface of the electrophotographic photoconductor 11 may also be used. This lubricant supply device may include a plate such as a cleaning blade to be pressed against the electrophotographic photoconductor 11 in a trailing manner or a counter manner.

EXAMPLES

Further understanding can be obtained by reference to certain specific examples which are provided herein for the purpose of illustration only and are not intended to be limiting. In the following examples, "part" and "%" represent "part by mass" and "% by mass", respectively.

Example 1

Preparation of Electrophotographic Photoconductor

The following intermediate layer coating liquid was applied onto an aluminum substrate (having an outer diameter of 100 mm) by dip coating to form an intermediate layer. The film thickness of the intermediate layer was 10 μm after drying at 170 degrees C. for 30 minutes.

Composition of Intermediate Layer Coating Liquid

- Zinc oxide particle (MZ-300 available from Tayca Corporation): 350 parts
- 1,3,5-tris(3-Mercaptobutyryloxyethyl)-1,3,5-triazine-2,4,6(1H, 3H, 5H)-trione (KARENZ (registered trademark) MT NR1 available from Showa Denko K.K.): 1.5 parts
- Blocked isocyanate (SUMIDUR (registered trademark) 3175, having a solid content concentration of 75%, available from Sumika Bayer Urethane Co., Ltd.): 60 parts
- 20% 2-Butanone solution of butyral resin (BM-1 available from Sekisui Chemical Co., Ltd.): 225 parts
- 2-Butanone: 365 parts The following charge generation layer coating liquid was applied onto the above-obtained intermediate layer by dip coating to form a charge generation layer. The film thickness of the charge generation layer was 0.3 μm.

Composition of Charge Generation Layer Coating Liquid

- Y-type titanyl phthalocyanine: 6 parts
- Butyral resin (S-LEC BX-1 available from Sekisui Chemical Co., Ltd.): 4 parts
- 2-Butanone (available from Kanto Chemical Co., Inc.): 200 parts The following charge transport layer coating liquid was applied onto the above-obtained charge generation layer by dip coating to form a charge transport layer. The film thickness of the charge transport layer was 22 μm after drying at 135 degrees C. for 20 minutes.

Composition of Charge Transport Layer Coating Liquid

- Bisphenol-Z-type polycarbonate (PANLITE TS-2050 available from Teijin Chemicals Ltd.): 10 parts
- Low molecular charge transport material having the following chemical structure: 10 parts

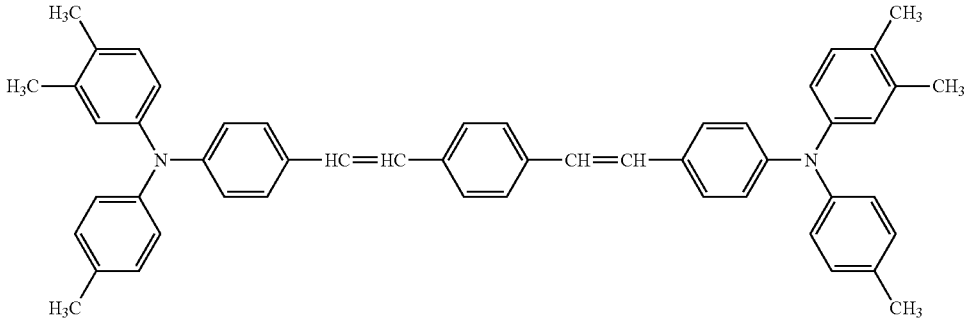

Tetrahydrofuran: 80 parts

Surface Layer

The following surface cross-linked resin layer coating liquid was applied onto the above-obtained charge transport layer by spray coating in nitrogen gas stream, then left in nitrogen gas stream for 10 minutes to become tack free, and irradiated with light in a UV emission booth the inside of which had been replaced with nitrogen gas so that the oxygen concentration was 2% or less.

After drying at 130 degrees C. for 20 minutes, an electrophotographic photoconductor of Example 1 was obtained. The film thickness of the surface cross-linked resin layer was 5.0 μm.

Light Irradiation Conditions

Metal halide lamp: 160 W/cm

Irradiation distance: 120 mm

Irradiation intensity: 700 mW/cm$^2$

Irradiation time: 60 seconds

Vehicle for Surface Cross-Linked Resin Layer

Trimethylolpropane triacrylate (KAYARAD TMPTA available from Nippon Kayaku Co., Ltd., a radical-polymerizable compound having three or more functional groups and no charge transporting structure and having an acrylic equivalent of 99): 10 parts Radical-polymerizable compound having a monofunctional charge transporting structure represented by the following structural formula (having an acrylic equivalent of 420): 10 parts

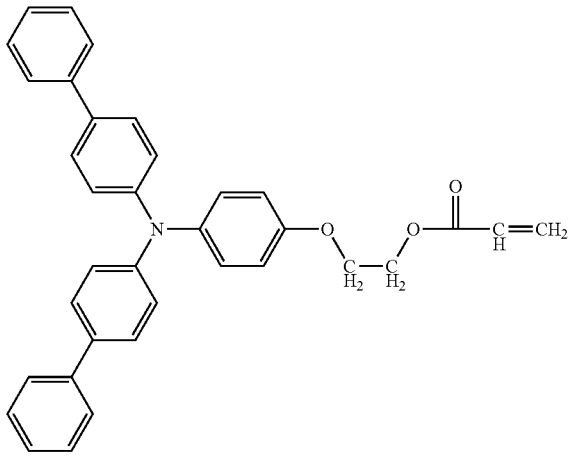

1-Hydroxy-cyclohexyl-phenyl-ketone (IRGACURE 184 available from Ciba Specialty Chemicals Inc., a photopolymerization initiator): 1 part Tetrahydrofuran: 119 parts Silicone oil (KF-50-100CS available from Shin-Etsu Chemical Co., Ltd.): 0.0042 parts Liquid Dispersion of Fluororesin Particles The following materials were put in a 50-cc mayonnaise bottle.

PSZ balls having a diameter of 1 mm (partially stabilized zirconia balls): 100 parts Perfluoroalkoxy fluororesin (PFA, MPE-056 available from Du Pont-Mitsui Fluorochemicals, Co., Ltd.): 11.25 parts Fluorine-based surfactant (GF-400 available from Toagosei Co., Ltd.): 4.5 parts Cyclopentanone: 66.75 parts The mayonnaise bottle was rotated at a rotational speed of 160 rpm for 6 hours, then the PSZ balls were separated to obtain a liquid dispersion of fluororesin particles.

Liquid Dispersion of Alumina Particles

The following materials were put in a 50-cc mayonnaise bottle.

Alumina balls having a diameter of 5 mm: 60 parts

Alumina particles (SUMICORUNDUM AA-03 available from Sumitomo Chemical Co., Ltd., having an average primary particle diameter of 0.3 μm): 9 parts Dispersant (50% THF solution of BYK-P105 available from BYK Japan KK): 0.36 parts Cyclopentanone: 9.8 parts The mayonnaise bottle was rotated at 160 rpm for 24 hours, then the alumina balls were removed. The resultant was diluted with THF so as to have a solid content concentration of 15%, thus obtaining a liquid dispersion of alumina particles.

A surface cross-linked resin layer coating liquid was prepared by pouring 85 parts of the vehicle into a mixture liquid of 10 parts of the liquid dispersion of fluororesin particles and 5 parts of the liquid dispersion of alumina particles, and formed into a film.

Example 2

An electrophotographic photoconductor was obtained in the same manner as in Example 1 except that the composition of the liquid dispersion of fluororesin particles was changed as follows.

Liquid Dispersion of Fluororesin Particles

The following materials were put in a 50-cc mayonnaise bottle.

PSZ balls having a diameter of 1 mm: 100 parts

Perfluoroalkoxy fluororesin (PFA, MPE-056 available from Du Pont-Mitsui Fluorochemicals, Co., Ltd.): 11.25 parts Fluorine-based surfactant (GF-400 available from Toagosei Co., Ltd.): 2.25 parts
Cyclopentanone: 65.25 parts Example 3

An electrophotographic photoconductor was obtained in the same manner as in Example 1 except that the composition of the liquid dispersion of fluororesin particles was changed as follows.
Liquid Dispersion of Fluororesin Particles
The following materials were put in a 50-cc mayonnaise bottle.
PSZ balls having a diameter of 2 mm: 100 parts
Perfluoroalkoxy fluororesin (PFA, MPE-056 available from Du Pont-Mitsui Fluorochemicals, Co., Ltd.): 11.25 parts
Fluorine-based surfactant (GF-400 available from Toagosei Co., Ltd.): 2.25 parts
Cyclopentanone: 65.25 parts Example 4

An electrophotographic photoconductor was obtained in the same manner as in Example 1 except that the compositions of the liquid dispersion of fluororesin particles and the liquid dispersion of alumina particles were changed as follows.
Liquid Dispersion of Fluororesin Particles
The following materials were put in a 50-cc mayonnaise bottle.
PSZ balls having a diameter of 2 mm: 100 parts
Perfluoroalkoxy fluororesin (PFA, MPE-056 available from Du Pont-Mitsui Fluorochemicals, Co., Ltd.): 11.25 parts
Fluorine-based surfactant (GF-400 available from Toagosei Co., Ltd.): 1.2 parts
Cyclopentanone: 65.45 parts
Liquid Dispersion of Alumina Particles
The following materials were put in a 50-cc mayonnaise bottle.
Alumina balls having a diameter of 5 mm: 40 parts
Alumina particles (SUMICORUNDUM AA-03 available from Sumitomo Chemical Co., Ltd., having an average primary particle diameter of 0.3 μm): 9 parts
Dispersant (50% THF solution of BYK-P105 available from BYK Japan KK): 0.36 parts
Cyclopentanone: 9.8 parts Example 5

An electrophotographic photoconductor was obtained in the same manner as in Example 1 except that the composition of the liquid dispersion of fluororesin particles was changed as follows.
Liquid Dispersion of Fluororesin Particles
The following materials were put in a 50-cc mayonnaise bottle.
PSZ balls having a diameter of 1 mm: 100 parts
Perfluoroalkoxy fluororesin (PFA, MPE-056 available from Du Pont-Mitsui Fluorochemicals, Co., Ltd.): 11.25 parts
Fluorine-based surfactant (MODIPER F606 available from NOF CORPORATION): 0.56 parts
Cyclopentanone: 66.94 parts Example 6

An electrophotographic photoconductor was obtained in the same manner as in Example 1 except that the compositions of the liquid dispersion of fluororesin particles and the liquid dispersion of alumina particles were changed as follows.
Liquid Dispersion of Fluororesin Particles
The following materials were put in a 50-cc mayonnaise bottle.
PSZ balls having a diameter of 1 mm: 100 parts
Perfluoroalkoxy fluororesin (PFA, MPE-056 available from Du Pont-Mitsui Fluorochemicals, Co., Ltd.): 11.25 parts
Fluorine-based surfactant (MODIPER F606 available from NOF CORPORATION): 0.45 parts
Cyclopentanone: 66.3 parts
Liquid Dispersion of Alumina Particles
The following materials were put in a 50-cc mayonnaise bottle.
Alumina balls having a diameter of 5 mm: 60 parts
Alumina particles (SUMICORUNDUM AA-07 available from Sumitomo Chemical Co., Ltd., having an average primary particle diameter of 0.7 μm): 9 parts
Dispersant (50% THF solution of BYK-P105 available from BYK Japan KK): 0.36 parts
Cyclopentanone: 9.8 parts Example 7

An electrophotographic photoconductor was obtained in the same manner as in Example 1 except that the compositions of the liquid dispersion of fluororesin particles and the liquid dispersion of alumina particles were changed as follows.
Liquid Dispersion of Fluororesin Particles
The following materials were put in a 50-cc mayonnaise bottle.
PSZ balls having a diameter of 1 mm: 100 parts
Perfluoroalkoxy fluororesin (PFA, MPE-056 available from Du Pont-Mitsui Fluorochemicals, Co., Ltd.): 11.25 parts
Fluorine-based surfactant (MODIPER F606 available from NOF CORPORATION): 0.45 parts
Cyclopentanone: 66.3 parts
Liquid Dispersion of Alumina Particles
The following materials were put in a 50-cc mayonnaise bottle.
Alumina balls having a diameter of 5 mm: 60 parts
Alumina particles (SUMICORUNDUM AA-1.5 available from Sumitomo Chemical Co., Ltd., having an average primary particle diameter of 1.5 μm): 9 parts
Dispersant (50% THF solution of BYK-P105 available from BYK Japan KK): 0.36 parts
Cyclopentanone: 9.8 parts Comparative Example 1

An electrophotographic photoconductor was obtained in the same manner as in Example 1 except that the compositions of the liquid dispersion of fluororesin particles and the liquid dispersion of alumina particles were changed as follows.
Liquid Dispersion of Fluororesin Particles
The following materials were put in a 50-cc mayonnaise bottle.
PSZ balls having a diameter of 1 mm: 60 parts
Perfluoroalkoxy fluororesin (PFA, MPE-056 available from Du Pont-Mitsui Fluorochemicals, Co., Ltd.): 11.25 parts Fluorine-based surfactant (MODIPER F606 available from NOF CORPORATION): 0.45 parts
Cyclopentanone: 66.3 parts
Liquid Dispersion of Alumina Particles
The following materials were put in a 50-cc mayonnaise bottle.
Alumina balls having a diameter of 5 mm: 60 parts
Alumina particles (SUMICORUNDUM AA-03 available from Sumitomo Chemical Co., Ltd., having an average primary particle diameter of 0.3 μm): 9 parts
Dispersant (50% THF solution of BYK-P105 available from BYK Japan KK): 0.36 parts
Cyclopentanone: 9.8 parts Comparative Example 2

An electrophotographic photoconductor was obtained in the same manner as in Example 1 except that the compositions of the liquid dispersion of fluororesin particles and the liquid dispersion of alumina particles were changed as follows.
Liquid Dispersion of Fluororesin Particles
The following materials were put in a 50-cc mayonnaise bottle.
PSZ balls having a diameter of 1 mm: 100 parts
Perfluoroalkoxy fluororesin (PFA, MPE-056 available from Du Pont-Mitsui Fluorochemicals, Co., Ltd.): 11.25 parts
Fluorine-based surfactant (MODIPER F606 available from NOF CORPORATION): 0.45 parts
Cyclopentanone: 66.3 parts
Liquid Dispersion of Alumina Particles
The following materials were put in a 50-cc mayonnaise bottle.
Alumina balls having a diameter of 5 mm: 60 parts
Alumina particles (SUMICORUNDUM AA-03 available from Sumitomo Chemical Co., Ltd., having an average primary particle diameter of 0.3 um): 9 parts
Dispersant (50% THF solution of BYK-P105 available from BYK Japan KK): 0.1 parts
Cyclopentanone: 9.8 parts
The above-prepared electrophotographic photoconductors of Examples 1 to 7 and Comparative Examples 1 to 2 were analyzed by SEM as follows.
Analysis by SEM
SEM Observation Conditions
Measurement instrument: QUANTA 200 3D (available from FEI Company Japan Ltd.)
Acceleration voltage: 0.8 kV
Grid voltage: 0 V
WD: 3.4 mm
Aperture diameter: 30 μm
Observation mode: SE2 image
Calculation of Average Particle Diameter of Particles and Area Ratio of Particles in Each Region in Cross-Sectional Image Observed by SEM
The calculation of the average particle diameter of the particles in the surface layer of the electrophotographic photoconductor and the area ratio of the particles in each segmented region in a cross-sectional image of the surface layer is described below.
FIG. 1A is a cross-sectional image of the surface layer of the electrophotographic photoconductor observed by SEM.
Specifically, FIG. 1A is a tiff image acquired from a cross-sectional image of the surface layer of the electrophotographic photoconductor containing the fluororesin particles, non-fluororesin particles, and cured resin, at a portion where these particles are contained, observed by SEM at a magnification of 5,000 times. This image gets provided with scale information with reference to a scale bar, then enhanced in contrast if necessary, and converted into an 8-bit image (Type 8-bit), by an image analysis software program imageJ. The threshold of image density can be adjusted such that the image of the fluororesin particles are extracted from the original image. The resulting image is illustrated in FIG. 1B. FIG. 1B is an image of the fluororesin particles extracted from the SEM image of FIG. 1A. Similarly, the threshold of image density can be adjusted such that the image of the non-fluororesin particles are extracted from the original image. The resulting image is illustrated in FIG. 1C. FIG. 1B is an image of the non-fluororesin particles extracted from the SEM image of FIG. 1A. Information of the particles present in the surface layer is acquired by performing the Analyze Particle command of imageJ for FIGS. 1B and 1C.
The area of each particle is measured to calculate the equivalent circle diameter. The average particle diameter of the particles is determined from the calculated equivalent circle diameters of the particles. The average particle diameter is determined based on the measurement results for at least 20 particles.
As particle information, longitudinal and lateral position information and area information are obtained. The image is segmented into uniform regions each having a longitudinal length of 1 μm and a lateral length of 4 μm, and the area occupied by the particles in each region is calculated. Description is made below with reference to FIGS. 2 and 3. FIG. 2 is a chart derived from a cross-sectional image of the surface layer of the electrophotographic photoconductor according to an embodiment of the present invention observed by SEM, segmented into uniform regions each being 1 μm×4 μm to show the positions and areas occupied by the fluororesin particles and the non-fluororesin particles in each region. FIG. 3 is a graph showing the area occupied by the fluororesin particles and the non-fluororesin particles in each region in the chart of FIG. 2.
The area occupied by the fluororesin particles and the non-fluororesin particles in each region is calculated as shown in the graph of FIG. 3, then the standard deviation of the areas each of which is occupied by the fluororesin particles and the non-fluororesin particles in each region is calculated.
Referring to FIG. 3, the standard deviation is calculated based on 18 regions with Nos. 7 to 24 shown in FIG. 2. As seen above, the standard deviation is calculated based on the regions in which the fluororesin particles and the non-fluororesin particles are contained in a predetermined amount or more (at least an amount worth calculating the standard deviation). For example, regions in each of which the random variable ranges from 0.25 to 0.75 in the probability distribution may be extracted. In this case, referring to FIGS. 2 and 3, the regions with Nos. 2 to 6 are not used to calculate the standard deviation.
In the case of segmenting the SEM image of the surface layer into uniform regions each being 1 μm×4 μm, the number of regions used to calculate the standard deviation can be appropriately selected depending on the types of particles and resin that constitute the surface layer and the mixing ratio thereof. However, as shown in FIGS. 2 and 3, it is preferable that the standard deviation is calculated based on around 18 regions.

After the electrophotographic photoconductors of Examples 1 to 7 and Comparative Examples 1 to 2 were implemented, each electrophotographic photoconductor was mounted on a black developing station of an electrophotographic apparatus (RICOH PRO C901 available from Ricoh Co., Ltd.) and a continuous print test was conducted under an environment of 30 degrees C., 90% RH with 100,000 sheets. The consumption of the lubricant relative to the running distance of the electrophotographic photoconductor was 220 mg/km. After completion of the test, the power switch was turned off and the apparatus was left for 16 hours, and then a halftone image pattern and a full white pattern were printed as an evaluation image. The evaluation image was evaluated by classifying the degree of image blurring into five ranks.

The lubricant used was the genuine product for RICOH PRO C901. The lubricant is a mixture of zinc stearate and zinc palmitate. The lubricant has been formed into a stick shape to be used in the image forming apparatus. The lubricant was scraped with a brush that was rotationally driven and applied to the surface of the electrophotographic photoconductor. The lubricant applicator used was the genuine product for RICOH PRO C901.

The consumption of the lubricant can be calculated by dividing the mass reduction of the lubricant by the traveling distance of the electrophotographic photoconductor.

The continuously printed image was a test pattern having an image area ratio of 5% in which characters and rectangular patches were regularly arranged over the entire of A4-size area.

Evaluation of Image Blurring

The halftone image pattern printed as described above was evaluated according to the following evaluation criteria.

Evaluation Criteria for Image Blurring

Rank 5: No image blurring observed.

Rank 4: Feeling of faint image blurring received.

Rank 3: Slight image blurring observed, but no problem in practical use.

Rank 2: Slight image blurring observed.

Rank 1: Clear image blurring observed.

The results of SEM analysis and evaluation of image blurring for the electrophotographic photoconductors of Examples 1 to 7 and Comparative Examples 1 to 2 were shown in Table 1.

As is clear from the results of the Examples, the electrophotographic photoconductor according to an embodiment of the present invention prevents image blurring, and makes it possible to provide an image forming apparatus sufficiently applicable for commercial printing.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. An electrophotographic photoconductor comprising:

a conductive substrate;

a photosensitive layer; and a surface layer containing fluororesin particles, non-fluororesin particles, and a cured resin, wherein the fluororesin particles have an average particle diameter of from 0.01 to 0.3 μm in a cross-sectional image of the surface layer as observed by a scanning electron microscope with a magnification of 5,000 times, wherein, when the cross-sectional image is segmented into uniform regions each being 1 μm×4 μm, a standard deviation of areas each of which is occupied by the fluororesin particles and the non-fluororesin particles in each of the regions is 0.2 $\mu m^2$ or less.

2. The electrophotographic photoconductor according to claim 1, wherein a standard deviation of areas each of which is occupied by the fluororesin particles in each of the regions is 0.15 $\mu m^2$ or less.

3. The electrophotographic photoconductor according to claim 1, wherein the non-fluororesin particles have an average particle diameter of from 0.1 to 1.0 μm in the cross-sectional image, wherein a standard deviation of areas each of which is occupied by the non-fluororesin particles in each of the regions is 0.15 $\mu m^2$ or less.

4. An image forming apparatus comprising:

the electrophotographic photoconductor according to claim 1; and

TABLE 1

| | Fluororesin Particles | | Non-Fluororesin Particles | | All particles | |
|---|---|---|---|---|---|---|
| | Average Particle Diameter (μm) | Standard Deviation of Occupied Areas ($\mu m^2$) | Average Particle Diameter (μm) | Standard Deviation of Occupied Areas ($\mu m^2$) | Standard Deviation of Occupied Areas ($\mu m^2$) | Image Blurring Evaluation (Rank) |
| Example 1 | 0.13 | 0.13 | 0.27 | 0.14 | 0.17 | 5 |
| Example 2 | 0.15 | 0.14 | 0.27 | 0.12 | 0.16 | 5 |
| Example 3 | 0.3 | 0.14 | 0.27 | 0.14 | 0.17 | 4 |
| Example 4 | 0.3 | 0.14 | 0.27 | 0.16 | 0.19 | 3 |
| Example 5 | 0.18 | 0.16 | 0.28 | 0.14 | 0.19 | 4 |
| Example 6 | 0.22 | 0.18 | 0.9 | 0.17 | 0.19 | 3 |
| Example 7 | 0.22 | 0.18 | 1.4 | 0.17 | 0.19 | 3 |
| Comparative Example 1 | 0.4 | 0.19 | 0.28 | 0.14 | 0.19 | 1 |
| Comparative Example 2 | 0.22 | 0.18 | 1.4 | 0.25 | 0.21 | 1 |

a lubricant supply device configured to supply a lubricant to the electrophotographic photoconductor.

5. An image forming method comprising:

forming an electrostatic latent image on the electrophotographic photoconductor according to claim 1; and supplying a lubricant to the electrophotographic photoconductor.

* * * * *